US006449448B2

(12) United States Patent
Bessho et al.

(10) Patent No.: US 6,449,448 B2
(45) Date of Patent: Sep. 10, 2002

(54) IMAGE FORMING APPARATUS WITH A RETURNED TONER TRANSFER FEATURE AFTER A NONIMAGE FORMATION OPERATION

(75) Inventors: Yuji Bessho, Shizuoka-ken; Yoshikuni Ito, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,935

(22) Filed: Dec. 29, 2000

(30) Foreign Application Priority Data

Jan. 6, 2000 (JP) ..... 2000-000846

(51) Int. Cl.[7] ..... G03G 15/02
(52) U.S. Cl. ..... 399/149; 399/100; 399/101
(58) Field of Search ..... 399/149, 150, 399/148, 100, 101

(56) References Cited

U.S. PATENT DOCUMENTS

| | | | | |
|---|---|---|---|---|
| 3,951,542 A | | 4/1976 | Ito et al. | |
| 4,004,714 A | | 1/1977 | Ito et al. | |
| 4,168,901 A | | 9/1979 | Ito et al. | |
| 5,168,313 A | * | 12/1992 | Hosaka et al. | 399/313 |
| 5,701,559 A | * | 12/1997 | Ootaka et al. | 399/149 |
| 5,740,494 A | * | 4/1998 | Shoji et al. | 399/71 |
| 5,765,076 A | * | 6/1998 | Ogata et al. | 399/168 |
| 5,832,336 A | * | 11/1998 | Kawasaki et al. | 399/71 |
| 5,835,821 A | | 11/1998 | Suzuki et al. | |
| 6,006,055 A | * | 12/1999 | Furuya | 399/149 |
| 6,215,967 B1 | * | 4/2001 | Takeda et al. | 399/43 |
| 2001/0016127 A1 | * | 8/2001 | Watanabe et al. | 399/149 |

FOREIGN PATENT DOCUMENTS

| | | |
|---|---|---|
| JP | 6-051672 | 2/1994 |
| JP | 10-31346 | 2/1998 |

* cited by examiner

*Primary Examiner*—Quana M. Grainger
(74) *Attorney, Agent, or Firm*—Fitzpatrick, Cella, Harper & Scinto

(57) ABSTRACT

An image forming apparatus includes an image carrier which carries an electrostatic image, a developing device for developing the electrostatic image using toner, a rotating transfer member which transfers a toner image on the image bearer, a charging device for charging an image bearer on which residual toner is deposited due to transfer by the rotating transfer member, the charging device allowing residual toner on the image bearer to be collected, and a returning device for returning toner in the charging device to the image bearer, the rotating transfer member transferring onto the rotating transfer member at least a portion of toner returned to the image bearer by the returning device.

29 Claims, 13 Drawing Sheets

IMAGE FORMING APPARATUS WITH A RETURNED TONER TRANSFER FEATURE AFTER A NONIMAGE FORMATION OPERATION

BACKGROUND OF THE INVENTION

1. Field of the Invention

The present invention relates to an image forming apparatus which uses electrophotography or electrostatic recording, such as a copying machine or a printer.

2. Related Background Art

Various image forming apparatuses, so-called tandem type color image forming apparatuses, have been proposed which superpose toner images in different colors formed by a plurality of image forming units (image forming stations) on recording material to form a color image.

FIG. 20 is a partially schematic view of such a color image forming apparatus. In the figure, the symbols SY, SM, SC, and SB represent first through fourth image forming stations disposed from right to left. The first through fourth image forming stations form a yellow toner image, a magenta toner image, a cyan toner image, and a black toner image, respectively.

The first through fourth image forming stations SY, SM, SC, and SB are electrophotography mechanisms. The stations have electrophotographic photosensitive members 1Y, 1M, 1C, and 1B as image bearers; charging units 2Y, 2M, 2C, and 2B; developing units 4Y, 4M, 4C, and 4B; cleaning units 6Y, 6M, 6C, and 6B; and so on. The electrophotographic photosensitive members 1Y, 1M, 1C, and 1B are rotated clockwise as indicated by an arrow at a predetermined process speed (circumferential speed) to form a toner image on their surfaces by charging; exposing LY, LM, LC, and LB; and developing.

The exposing units, not shown, are laser beam scanners, for example. The laser beam scanners comprise a semiconductor laser, a polygon mirror, an F-θ lens, and so on. To expose the uniformly charged surface of rotating photosensitive drum to a laser beam by scanning, the scanners emit the laser beam. This beam is modulated according to a time-series electric digital image signal carrying intended image information fed from a host apparatus (not shown) including manuscript reader having photoelectric conversion elements, such as CCD, a computer, a word processor, etc. Exposure by laser beam scanning forms on the surface of the rotating photosensitive drum an electrostatic latent image according to the intended image information.

The exposure LY in the first image forming station SY corresponds to the cyan component of a full-colored image. The developing unit 4Y uses a developer containing a cyan toner.

The exposure LM in the second image forming station SM corresponds to the magenta component of a full-colored image. The developing unit 4M uses a developer containing a magenta toner.

The exposure LC in the third image forming station SC corresponds to the yellow component of a full-colored image. The developing unit 4C uses a developer containing a yellow toner.

The exposure LB in the fourth image forming station SB corresponds to the black component of a full-colored image. The developing unit 4B uses a developer containing a black toner.

Reference numeral 51 denotes an endless belt type recording medium carrier (hereinafter called a transfer belt). The transfer belt 51 is almost horizontally tensioned under the image forming stations SY, SM, SC, and SB, across the image forming stations, and between a drive roller 52 and a turn roller 53. A drive motor 54 drives the drive roller 52, so that the transfer belt 51 turns counterclockwise as indicated by an arrow at a predetermined process speed.

The transfer belt 51 is made of a sheet of dielectric resin, such as polyethylene telephthalate (PET), polyvinylidene fluoride, or polyurethane. The belt is endless, that is, its original ends are connected together, or it is seamless.

Reference numerals 55Y, 55M, 55C, and 55B are transfer charging blades. The blades are disposed inside the transfer belt 51, with the upper half of the transfer belt 51 pressed against the underside of the photosensitive members 1Y, 1M, 1C, and 1B in the image forming stations SY, SM, SC, and SB. In the image forming stations, SY, SM, SC, and SB, the contacts between the underside of the photosensitive members 1Y, 1M, 1C, and 1B and the transfer belt 51 provides first through fourth transfer units (transfer nips) TY, TM, TC, and TB.

Reference numeral 56 is a cleaning unit for the transfer belt 51 (transfer belt cleaner). The transfer belt cleaner presses a cleaning web (non-woven fabric) 57 against the transfer belt 51 to remove residual toner and other foreign material from the transfer belt.

A sheet feeding apparatus, not shown, feeds recording material P (material onto which an image is transferred), and a registration roller 8 places the material P on the upper half of the transfer belt 51 from the side of the first image forming station SY at a predetermined control timing.

The recording material P on the transfer belt 51 is electrostatically attracted to the belt 51. As the transfer belt 51 turns, the material is conveyed from the first transfer unit TY to the second transfer unit TM, to the third transfer unit TC, to the fourth transfer unit TB. Images are transferred onto the material P as follows:

1) The first transfer unit TY transfers a cyan toner image formed on the surface of the photosensitive member 1Y in the first image forming station SY.

2) The second transfer unit TM transfers a magenta toner image formed on the surface of the photosensitive member 1M in the second image forming station SM.

3) The third transfer unit TC transfers a yellow toner image formed on the surface of the photosensitive member 1C in the third image forming station SC.

4) The fourth transfer unit TB transfers a black toner image formed on the surface of the photosensitive member 1B in the fourth image forming station SB.

By transferring and superposing these four toner images, a toner image corresponding to an intended full-colored image is composited on the material P.

Toner images start to be formed in synchronism with each other at the first through fourth image forming stations SY, SM, SC, and SB. Thus the toner images formed at the image forming stations are transferred onto recording material P, which is conveyed on the transfer belt 51, so that the images are positioned and superposed as predetermined.

After the recording material P is conveyed on the belt through the fourth transfer unit TB, electricity is discharged from the recording material P by the electricity discharging apparatus 9. Then the material is separated from the transfer belt 51 and introduced into a thermal fixing apparatus, not shown. The apparatus fixes an unfixed toner image on the recording material as a permanent image by melting and color mixing. Finally, the material, which bears a fixed image, is discharged.

After image transfer, residual toner on the photosensitive members 1Y, 1M, 1C, and 1B in the image forming stations SY, SM, SC, and SB is removed by the cleaning units 6Y, 6M, 6C, and 6B.

Toner and other foreign material deposited on the transfer belt 5 is removed by the cleaning unit 56.

Besides color image forming apparatuses which have a plurality of image bearers 1Y, 1M, 1C, and 1B as described above, a color image forming apparatus is available which repeats a process consisting of charging, latent-image formation, development, and cleaning, using one image bearer to form a color image. Some of these color image forming apparatuses are of a type which attracts recording material to a transfer belt or a transfer drum to superpose toner images one after another on the same recording material and of an intermediate transfer type which superposes a plurality of toner images on an intermediate transfer member and transfers the all superposed images onto the recording material.

For such an electrophotographic apparatus, a cleanerless type, in which the cleaner for cleaning the residual toner on the photosensitive member after image transfer is eliminated and a developing device collects and reuses the residual toner, is contemplated.

When an image forming apparatus of a simultaneous development/cleaning type (cleanerless process type) repeats image formation, the preceding image is slightly left, that is, a so-called positive ghost occurs, because residual toner cannot be collected by the developing device completely.

If an image bearer part under the residual toner cannot be charged when the residual toner on the image bearer passes a charging member, fog removal potential (Vback) which is sufficient to collect residual toner using a developing device cannot occur in the image bearer part. This phenomenon causes a positive ghost.

If a contact type charging member is used, the contact charger is contaminated, thus resulting in a marked positive ghost.

To prevent a positive ghost, Japanese Patent Application Laid-Open No. 10-31346 proposes a method for properly developing an image and collecting toner at the same time. The method consists of the following sequential steps: (1) collecting residual toner in a contact type charging member, (2) giving a regular charging polarity to the collected toner by friction between the toner and the contact type charging member to form an electrostatic latent image on an image bearer, and (3) discharging the collected toner onto a photosensitive member.

Although the method is used, transfer efficiency may significantly decrease due to, for example, continuous formation of images with a high image ratio, temperature, humidity, the type of paper, etc. In such a case, the amount of collected toner markedly increases, thus preventing discharged toner from being collected completely at a location of development. Discharged toner which passes the location shows up as smears on recording material.

By analogy with Japanese Patent Application Laid-Open No. 6-51672, collected toner could be intentionally discharged onto that portion of the surface of a photosensitive member which paper does not pass to prevent smears from occurring on recording material. Indeed, this method reduces smears if discharged toner cannot be collected completely.

For example, if transfer efficiency significantly decreases due to continuous formation of images with a high image ratio, temperature, humidity, the type of paper, etc., toner collected by a contact type charging member and then discharged is recollected after it passes locations of development and transfer. Thus the amount of residual toner on an image bearer increases. Accordingly, the amount of toner collected by the contact type charging member also increases. Because the residual toner attaches to the contact type charging member and enters it when collected by the charging member, the electric resistance of the contact type charging considerably changes. For example, if the contact type charging member is a magnetic brush charger (injection charger), toner enters the magnetic brush, thus increasing its electrical resistance. As a result, an enough charge does not transfer when the brush passes a charging nip. This causes the potential of the surface of the photosensitive member to be lower than a voltage applied after the brush passes the charging nip. A potential difference $\Delta V$ between the potential of the surface of the photosensitive member and the applied voltage increases with the amount of toner entering the magnetic brush, so that fog occurs in a developing portion.

A problem with the color image forming apparatuses is that in a tandem system or other system, when another color is to be transferred, the toner image once transferred onto the recording material or intermediate transfer member is transferred again onto the image bearer (hereinafter referred to as "retransfer"), so that a desirable toner image cannot be obtained.

Considering that all color image forming apparatuses reproduce all colors by superposing chromatic colors, retransfer has an effect on all chromatic colors superposed on the entire recording material.

In a tandem type color forming apparatus which incorporates a cleanerless process, residual toner and retransferred toner are collected using a fog removal bias Vback during development. Because retransferred toner differs in color from residual toner, a developer causes color mixing when retransferred toner is recollected during development as is residual toner. Toners in different colors are accumulated in a developing device as image formation proceeds, so that desired colors cannot be obtained. This phenomenon is remarkable if a large amount of toner is retransferred.

For a contact charging type transfer image forming apparatus which uses a cleanerless process, if residual toner attaches to a contact charging member or enters the member when collected by the member, the electrical resistance of the member changes. For example, if the contact charging member is a magnetic-brush charger (injection charger), toner enters the magnetic brush, so that its electrical resistance gradually increases. Thus while a photosensitive member passes a charging nip, an enough charge does not move. Consequently, the photosensitive-member surface potential is lower than an applied voltage. The larger the amount of toner entering the magnetic brush, the larger the difference $\Delta V$ between the photosensitive-member surface potential and the applied voltage. As a result, fog occurs in a developing portion. To prevent this problem, the amount of toner entering the magnetic brush must be kept equal to or less than a certain value.

If toner introduced into the magnetic-brush charger is given a charge with the same polarity as the photosensitive-member potential by contact with magnetic-brush carriers (magnetic particles and charging carriers), an electric field produced by the difference $\Delta V$ discharges toner from the magnetic brush onto the photosensitive member. As disclosed in U.S. Pat. No. 5,835,821, a method is known which, when no image is formed, reduces the amplitude Vpp of the AC component of a charging bias or stops application of the AC component, using development to increase the difference ΔV, thus promoting toner discharge to inhibit the electrical resistance of the magnetic brush from increasing.

Discharging toner between sheet transfers or in a post-rotation process after image formation is completed allows the amount of toner entering the magnetic brush to be kept equal to or less than a certain value for prolonged periods of time.

A problem with multiple-transfer image forming apparatuses is that discharged toner which is transferred onto the transfer belt in an upstream image forming unit is retransferred onto the photosensitive drum in a downstream image forming unit and collected by the charging portion of the downstream image forming unit, thus resulting in deteriorated charging performance. The inventors found that the amount of the retransferred toner increases with that of the discharged toner.

SUMMARY OF THE INVENTION

It is an object of the present invention to provide an image forming apparatus which keeps good charging performance for prolonged periods of time.

It is another object of the present invention to provide an image forming apparatus which collects and discharges toner using a charger.

It is still another object of the present invention to provide an image forming apparatus which prevents toner discharged from a charger from adversely affecting an image.

It is further object of the present invention to provide an image forming apparatus comprising:

an image carrier which carries an electrostatic image;

developing means for developing the electrostatic image using toner;

a rotating transfer member which transfers a toner image on the image bearer;

charging means for charging the image bearer on which residual toner is deposited after transfer by the rotating transfer member, the charging means allowing the residual toner on the image bearer to be collected; and returning means for returning the toner in the charging means to the image bearer, in which the rotating transfer member transferring onto the rotating transfer member at least a portion of the toner returned to the image bearer by the returning means.

Other objects of the present invention will be clear from the following descriptions.

DETAILED DESCRIPTION OF THE PREFERRED EMBODIMENTS

Figure 1:
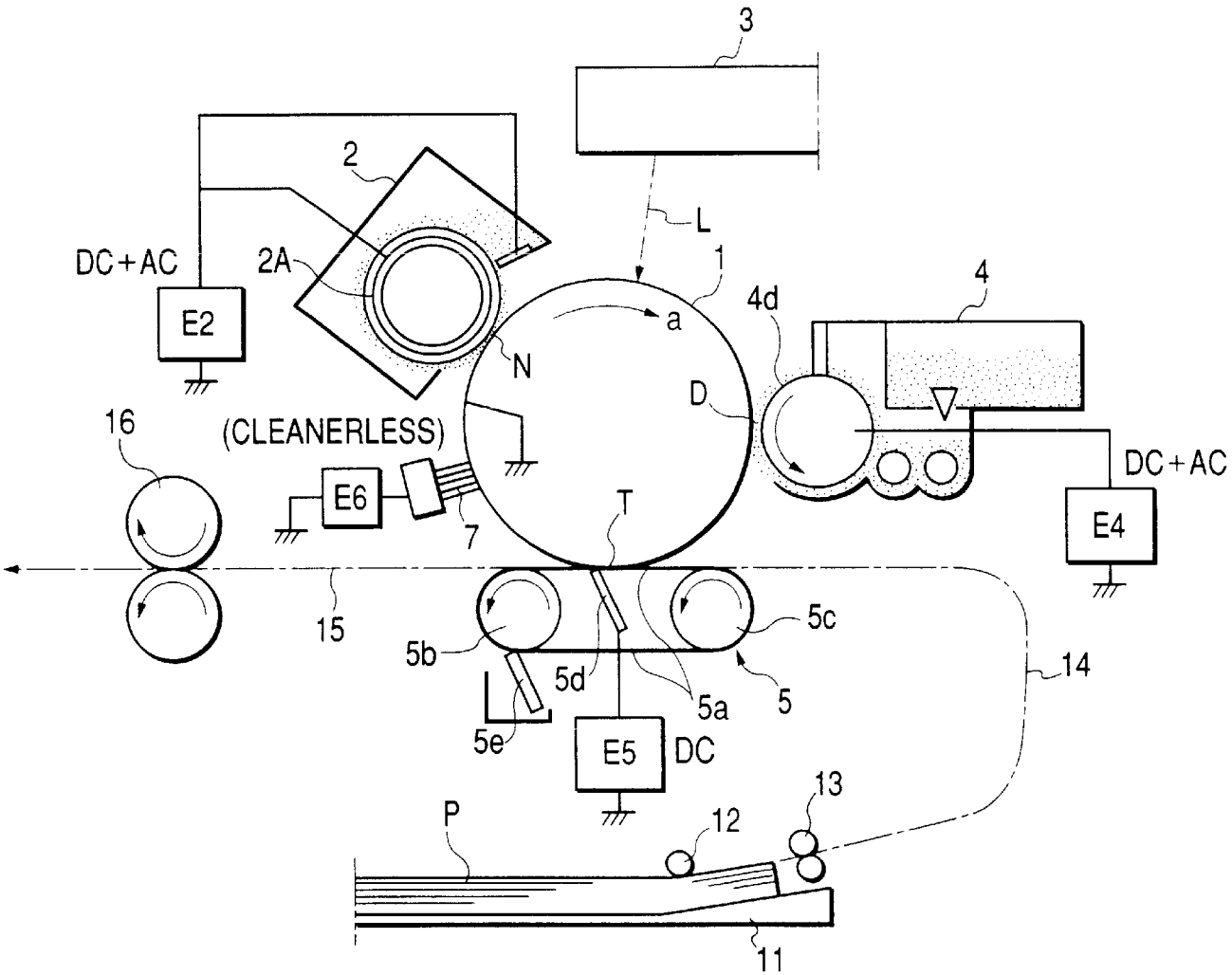
FIG. 1 is a schematic view of an image forming apparatus of a first embodiment.

Referring now to the drawings, the embodiments of the present invention will be described below.

<First Embodiment> (FIGS. 1 through 11)

(1) Example of Image Forming Apparatus (FIG. 1)

FIG. 1 is a schematic view of an image forming apparatus. The apparatus is a charge injection charging type laser beam printer which uses a transfer electrophotographic process and a cleanerless process.

Reference numeral 1 denotes a rotating drum type electrophotographic photosensitive member (hereinafter called a photosensitive drum). The photosensitive drum 1, an OPC photosensitive member (organic photoconductive photosensitive member) which is negatively charged by charge injection, is rotated clockwise a as indicated by an arrow at a process speed (circumferential speed) of 150 mm/sec.

Reference numeral 2 denotes a contact charging apparatus which uniformly charges the surface of the photosensitive drum 1 so that the surface has a predetermined polarity and is at a predetermined potential. The contact charging apparatus is a magnetic brush charging apparatus. The magnetic brush charging apparatus 2 uniformly charges the surface of the rotating photosensitive drum 1 by charge injection until the surface is at a potential of about −700 V.

Reference numeral 3 denotes image information exposing means (exposing apparatus). The image information exposing means is a laser beam scanner. The scanner 3 consists of a semiconductor laser, a polygon mirror, an F-θ lens, etc. The scanner emits a laser beam L to expose the uniformly charged surface of the rotating photosensitive drum 1 to a laser beam by scanning. This beam is modulated according to a time-series electric digital image signal carrying intended image information fed from a host apparatus having photoelectric conversion elements, including CCDs. The host apparatus, not shown, is a manuscript reader, a computer, a word processor, etc. Exposure by laser beam scanning forms on the surface of the rotating photosensitive drum 1 an electrostatic latent image according to the intended information.

Reference numeral 4 denotes a developing apparatus (developing device). The embodiment uses a highly separable spherical-particle non-magnetic toner and a 2-component contact development type developing apparatus. The toner, which is produced by polymerization, leaves few residues. Using a developer mixed with magnetic carriers, the developing apparatus reversely develops the electrostatic latent image on the rotating photosensitive drum 1 to form a toner image.

Reference numeral 5 denotes a transferring apparatus disposed under the photosensitive drum 1 and the apparatus used in this embodiment is of a transfer belt type. Reference numeral 5*a* denotes an endless transfer belt (for example, a polyimide belt 75 $\mu$m thick) which bears recording material. The belt is tensioned between a drive roller 5*b* and a driven roller 5*c*. It is rotated at almost the same circumferential speed in the same direction as is the photosensitive drum 1. Reference numeral 5*d* denotes an electrically conductive blade disposed inside the transfer belt 5*a*.

The blade forms a transfer nip T as a transferring element, with the upper half of the transfer belt 5*a* pressed against the underside of the photosensitive drum 1.

Reference numeral 5*e* denotes a cleaning member (transfer belt cleaner) which cleans the surface of the transfer belt 5*a*. The member is an elastic blade pressed against the transfer belt 5*a*.

Reference numeral 11 denotes a sheet feed cassette, which is loaded with recording material P (material onto which an image is transferred) P, such as paper. A sheet feed roller 12 takes a sheet of recording material P out of the sheet feed cassette 11 and conveys it through a sheet path 14, including a conveying roller 13, to the transfer nip T between the rotating photosensitive drum 1 and the transfer belt 5*a* of the transferring apparatus 5 at a predetermined control timing.

After reaching the transfer nip T, the recording material P is further conveyed between the rotating photosensitive drum 1 and transfer belt 5*a*. A transfer bias applying power supply E5 applies a predetermined bias to the electrically conductive blade 5*d* to charge the material P from its back so that it is opposite in polarity to the toner. Thus a toner image on the photosensitive drum 1 is electrostatically transferred little by little onto the face of the recording material P which goes through the transfer hip T. After image transfer is completed, the cleaning member 5*e* cleans the transfer belt 5*a*.

After the toner image is transferred onto the recording material P through the transfer hip T, the material is gradually separated from the photosensitive drum 1, introduced through the sheet path 15 into a fixing apparatus 16 (for example, a heat roller fixing apparatus) to fix the toner image, and discharged.

The printer in this embodiment, which uses a cleanerless process, has no special cleaner to remove toner which is not transferred onto the recording material P yet left on the photosensitive drum 1. However, as described below, when residual toner-reaches a charging nip N of the magnetic-brush charging apparatus 2 as the photosensitive drum 1 rotates, it is temporarily collected by a magnetic brush of a magnetic-brush charger (an injection charger) 2A. This charger is a contact charging member which is in contact with the photosensitive drum 1. The collected toner is discharged again onto the photosensitive drum 1. Finally, the toner is collected by the developing apparatus 4 at a development location D to repeatedly use the photosensitive drum 1 for image formation.

Toner is discharged from the magnetic-brush charger 2A onto the photosensitive drum 1 under the action of an electric field generated by the potential difference $\Delta V$. Here the toner has a charge which has the same polarity as does the photosensitive drum, because the toner is in contact with a magnetic-brush carrier, magnetic particles, or a charging carrier. When no image is being formed, the amplitude Vpp of the alternative-current (AC) component of a charging bias is reduced or AC component application is stopped to increase the potential difference $\Delta V$. Thus toner discharge is promoted to prevent the electrical resistance of the magnetic brush from increasing.

Reference numeral 7 denotes an electrically conductive brush which is brought into contact with the photosensitive drum 1 between the transferring apparatus 5 and the magnetic-brush charging apparatus 2 to apply an AC bias, a DC bias opposite in polarity to charging, or and AC bias and a DC bias opposite in polarity to charging together to the brush. Immediately before the magnetic-brush charging apparatus 2 charges the photosensitive drum 1, the brush on one hand levels the polarity of the surface of the photosensitive drum 1 and on the other hand discharges electricity from residual toner or charges it opposite in polarity to the photosensitive drum 1 to help the magnetic brush of the magnetic-brush charger 2A collect toner. E6 is a bias applying power supply for the electrically conductive brush 12.

Figure 2:
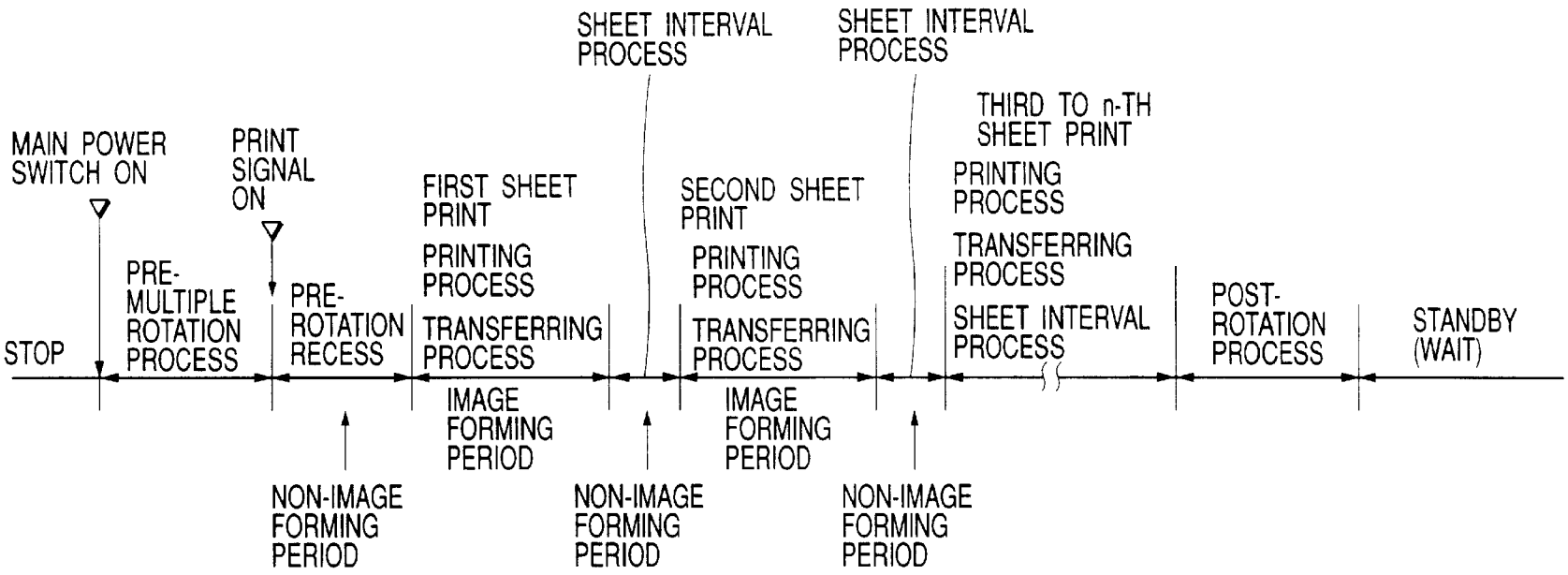
FIG. 2 shows an operational sequence for the image forming apparatus.

(2) Operational Sequence for the Printer (FIG. 2)

FIG. 2 shows an operational sequence for the printer.

a. Pre-multiple-rotation process: A printer start period (a printer start-up period and a warm-up period). The main power switch is turned on to start the main motor of the printer, which in turn rotates the photosensitive drum 1 to make predetermined process equipment ready for operation.

b. Pre-rotation process: A period of pre-printing operation. This process follows the pre-multiple-rotation process if a print signal is fed during the pre-multiple-rotation process. If no print signal is fed, the main motor stops after the pre-multiple-rotation process is completed. As a result, the photosensitive drum 1 also stops, thus keeping the printer on standby until a print signal is fed. When a print signal is fed, the pre-rotation process is performed.

c. Printing process (image forming process and imaging process): After the pre-rotation process is completed, an image is formed on the rotating photosensitive drum. Then the toner image is transferred from the rotating photosensitive drum onto recording material and fixed by fixing means, and the material is discharged.

In a continuous printing mode, the printing process is repeated a number of times which is equal to the set number of sheets to be printed.

d. Intersheet process: The period between the time when the rear end of a sheet of recording material passes the transfer nip T in the continuous printing mode to the time when the front end of the following sheet of recording material reaches the transfer nip T. During this period, no recording material passes the transfer nip.

While a region on the surface of the rotating photosensitive drum which passes the transfer nip T within the period passes the charging nip N before passing the transfer nip, application of the AC component of a charging bias is stopped to discharge residual toner temporarily collected by the magnetic-brush charging member 2A onto the rotating photosensitive drum 1.

e. Post-rotation process: After printing on the last sheet of recording material is completed, the main motor is kept running for some time to continue rotation of the photosensitive drum to perform predetermined post operations.

As is the case with the intersheet period, during this period also, application of the AC component of a charging bias is stopped to discharge residual toner temporarily collected by the magnetic-brush charging member 2A onto the rotating photosensitive drum 1.

f. Standby: After the predetermined post-rotation operations are completed, the main motor is stopped to stop the photosensitive drum 1. The printer is kept on standby until the next print start signal is fed.

When only one sheet of recording material is printed, the printer enters the standby mode through the post-rotation process after printing.

In the standby mode, the printer shifts to the pre-rotation process when a print start signal is fed.

In the printing process c, an image is formed. In the pre-multiple-rotation process a, pre-rotation process b, intersheet process d, and post-rotation process e, on the other hand, no image is formed.

Figure 3:
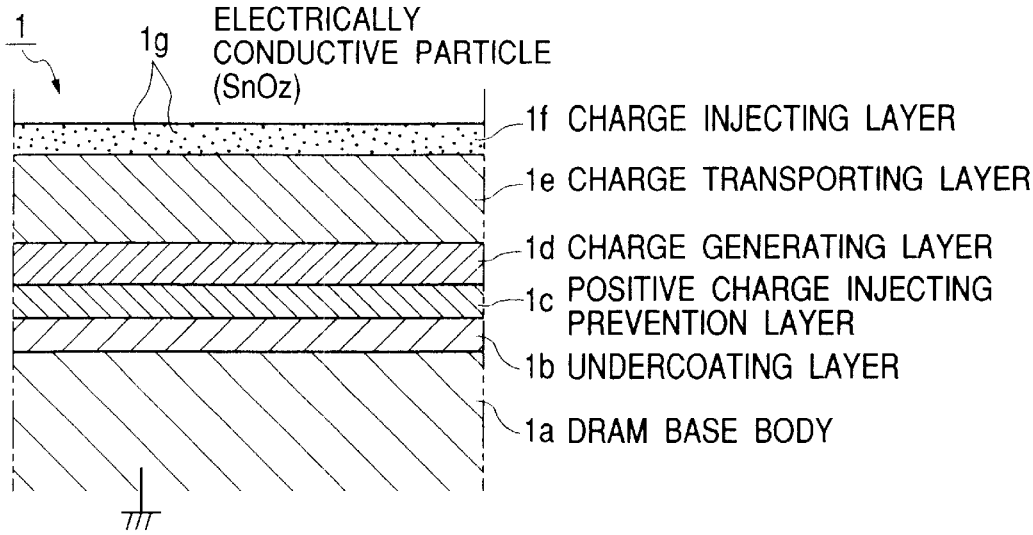
FIG. 3 is a schematic view showing photosensitive-drum layers.

(3) Photosensitive Drum 1 (FIG. 3)

As described above, the photosensitive drum 1 is an OPC photosensitive member which is negatively charged by charge injection. As shown in FIG. 3, a schematic view, the photosensitive drum is made by providing first through fifth functional layers 1*b* through 1*f* in that order on an aluminum drum body 1*a* 30 mm in diameter.

The first layer 1*b* is an electrically conductive underlayer about 20 $\mu$m thick. This layer is provided to repair defects in the aluminum drum body 1*a* and prevent moire due to laser beam reflection during exposure.

The second layer 1*c* is a positive-charge injection prevention layer. This layer prevents a positive-charge injected from the aluminum drum body 1*a* from canceling a negative charge on the surface of the photosensitive member. The layer is about 1 $\mu$m thick. Its resistance is adjusted to about $10^6$ $\Omega$·cm, using amilan resin and methoxymethyl nylon.

The third layer 1*d* is a charge producing layer about 3 $\mu$m thick made by dispersing a disazo pigment in resin. The layer produces a pair of positive and negative charges when exposed to a laser beam.

The fourth layer 1*e* is a charge conveying layer made by dispersing hydrazone in polycarbonate resin. The fourth layer is also a p-type semiconductor. Thus only a positive charge produced in the charge producing layer 1*d* can be conveyed on the surface of the photosensitive member, but a negative charge on the surface of the photosensitive member cannot be moved in the fourth layer.

The fifth layer 1*f* is an applied charge injection layer about 3 $\mu$m thick which is made by dispersing 1 gram of ultra-fine $SnO_2$ particles 0.03 $\mu$m in diameter in resin at a weight ratio of 70:100. These $SnO_2$ particles are given a reduced resistance (that is, made electrically conductive) by doping photo-curing acrylic resin as a binder with antimony which is a translucent conductive filler. To satisfactorily charge the charge injection layer If and prevent image shift, the layer is required to have an electrical resistance of $1\times10^{10}$ to $1\times10^{14}$ $\Omega$·cm. The embodiment uses a photosensitive drum whose surface has a resistance of $1\times10^{11}$ $\Omega$·cm.

Figure 4:
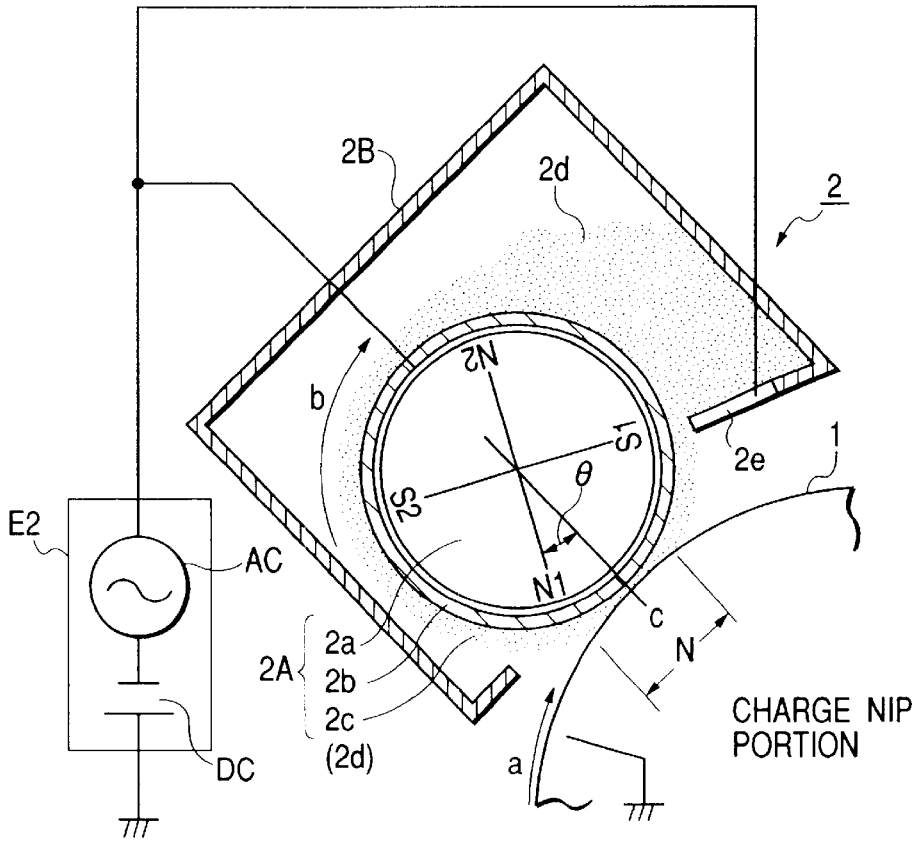
FIG. 4 is an enlarged schematic cross-sectional view of a magnetic-brush charging apparatus.
Figure 5:
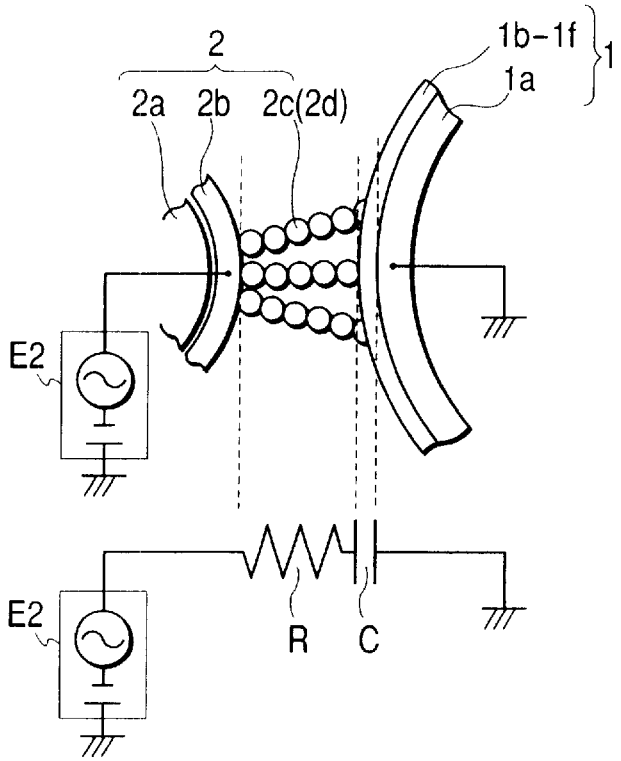
FIG. 5 shows a circuit equivalent to a charging circuit.
Figure 6:
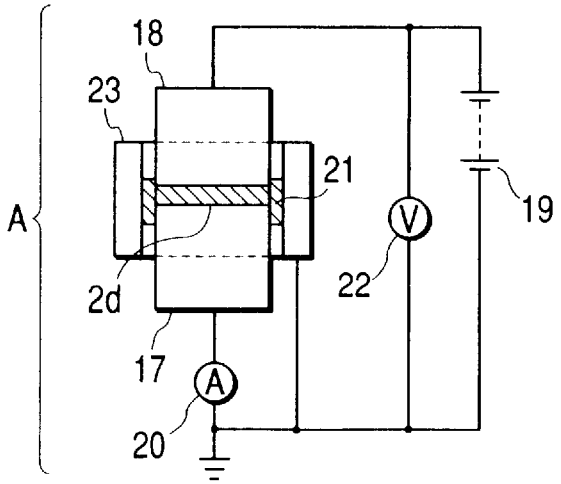
FIG. 6 illustrates a procedure for measuring the electrical resistance (volume resistance) of a magnetic particle (charged carrier)

(4) Magnetic-brush Charging Apparatus 2 (FIGS. 4 through 6)

FIG. 4 is an enlarged schematic view of the magnetic-brush charging apparatus 2. The apparatus consists roughly of the magnetic-brush charging member (magnetic-brush charger) 2A, a housing 2B containing the magnetic-brush charger 2A and electrically conductive magnetic particles (charging carriers) 2*d*, and a charging bias applying power supply E2 for the magnetic-brush charger 2A.

The magnetic-brush charger 2A of the embodiment is of a sleeve rotation type. The charger consists of a magnetic roll (magnet) 2*a*, a non-magnetic stainless steel sleeve 2*b* fit over the roll (this sleeve is called an electrode sleeve, an electrically conductive sleeve, or a charging sleeve), and a magnetic brush 2*c* which is formed by securing the magnetic particles 2*d* around the sleeve 2*d* using magnetism from the magnetic roll 2*a*.

A drive system, not shown, rotates the sleeve 2*b* around magnetic roll 2*a*, a stationary member, clockwise as indicated by an arrow b at a predetermined circumferential speed (for the embodiment, 225 mm/sec). The sleeve 2*b* is disposed opposite to the photosensitive drum 1, with a clearance about 500 $\mu$m wide kept in between by spacer rollers, etc.

Reference numeral 2*e* denotes a non-magnetic stainless steel blade which limits the thickness of the magnetic brush. The blade is attached to the housing 2B so that a clearance 900 $\mu$m wide is provided between the surface of the sleeve 2*b* and the blade.

Part of the magnetic particles 2*d* in the housing 2B, which are secured around the sleeve 2*b* under the action of magnetism from the magnetic roll 2*a* in the sleeve, provides the magnetic brush 2*c*. As the sleeve 2*b* rotates, the magnetic brush 2*c* rotates together with the sleeve 2*b* in the same direction. During rotation, the blade 2*e* limits the magnetic brush 2*c* to a certain thickness. Because the thickness is larger than the width of the clearance between the sleeve 2*b* and the photosensitive drum 1, the magnetic brush 2*c* comes in contact with the photosensitive drum 1 between the sleeve 2*b* and the photosensitive drum 1, thus forming a nip with a predetermined width, that is, the charging nip N (a charging location). Consequently, the rotating photosensitive drum 1 is rubbed at the charging nip N by the magnetic brush 2*c* as the sleeve 2*b* of the magnetic-brush charger 2A rotates. The photosensitive drum 1 and magnetic brush moves in opposite directions at the charging nip N, so that their relative speed increases.

The power supply 2E applies a predetermined bias to the sleeve 2*b* and magnetic-brush thickness limiting blade 2*e*.

As described above, the photosensitive drum 1 and sleeve 2*b* are rotated, and the power supply 2E applies the predetermined bias to the blade, so that the surface of the photosensitive drum 1 is uniformly charged by charge injection, with the drum in contact with the brush, to give the drum a predetermined polarity and predetermined potential.

A magnetic pole (main pole) N1 of the magnetic roll 2*a*, secured in the sleeve 2*b*, disposed 10° in the direction of rotation of the photosensitive drum upstream from the position c where the sleeve 2*b* and the photosensitive drum 1 is nearest to each other. The pole produces a magnetic field with a strength of about 900 G.

The symbol θ denotes the angle between the position c and the main pole N1. It is desirable that the angle 0 falls within a range from 20°, upstream in the direction of rotation of the photosensitive drum to 10° downstream in the direction, more preferably 15° to 0° upstream in the direction. If the pole is 10° or more in the opposite direction away from the position c, magnetic particles are attracted to the pole, so that they are liable to be deposited in that part of the photosensitive drum which is behind the charging nip N in the opposite direction. If the pole is 20° or more in the direction of rotation of the photosensitive drum away from the position c, magnetic particles are difficult to convey after they pass the charging nip N. Thus they are also liable to be deposited.

If the pole is not at the charging nip N, attraction to the sleeve 2*b* of magnetic particles becomes weak, so that they easily attach to the photosensitive drum 1, clearly.

The charging nip N described here is a region where magnetic particles constituting the magnetic brush 2*c* are in contact with the photosensitive drum 1 during charging.

The power supply 2E applies a charging bias to the sleeve 2*b* and limiting blade 2*e*. The embodiment uses a bias whose DC and AC components are superposed.

At the charging nip N, the magnetic brush 2*c* of the magnetic-brush charger 2A rubs the photosensitive drum 1. A charging bias is applied to the magnetic-brush charger 2A. These two operations cause magnetic particles 2*d* constituting the magnetic brush 2*c* to give charges to the photosensitive drum 1. Thus the surface of the drum is uniformly charged by contact with the particles so that the surface has a predetermined polarity and is at a predetermined potential. As described above, the photosensitive drum 1 has the charge injection layer 1*f* on its surface, the drum 1 is charged by charge injection. That is, the surface of the photosensitive drum 1 is charged until the surface reaches a potential corresponding to the DC component of the charging bias DC+AC. The faster the sleeve 2*b* rotates, the more uniformly the photosensitive drum is charged.

The magnetic-brush charger 2A charges the photosensitive drum 1 by charge injection. This operation can be illustrated using an equivalent circuit in FIG. 5 which consists of a resistor R and a capacitor C. The potential Vd of the surface of the photosensitive drum 1 is expressed by the following equation.

$$Vd=Vo(1-\exp(To/(Cp\cdot r)) \qquad \text{Equation (1)}$$

where r represents the resistance of the resistor, Cp the electrostatic capacity of the photosensitive member, Vo an applied voltage, To the charging time (time required for a point on the surface of the photosensitive drum to pass the charging nip N). The DC component of the charging bias DC+AC is the same as the potential of the surface of the photosensitive drum, −700 V for the embodiment.

When an image is formed, the AC component peak-to-peak voltage (amplitude) Vpp is 100 V or more and 200 V or less, preferably 300 V or more and 1200 V or less. A peak-to-peak voltage Vpp of less than 100 V does not significantly improve charging uniformity or potential rising. On the other hand, a peak-to-peak voltage Vpp higher than 1200 V causes more magnetic particles to stagnate and attach to the photosensitive drum.

Frequency is 100 Hz or more and 5000 Hz or less, preferably 500 Hz or more and 2000 Hz or less. A frequency of less than 100 Hz causes more magnetic particles to attach to the photosensitive drum. Such a frequency does not significantly improve charging uniformity or potential rising, either. This is also the case with a frequency of more than 5000 Hz.

The waveform of the AC component is preferably rectangular, triangular, or sinusoidal. The embodiment uses a peak-to-peak voltage Vpp of 700 V.

The embodiment uses as magnetic particles 2*d*, constituting the magnetic brush 2*c*, sintered ferromagnetic particles (ferrite) which are reduced. Also available are particles formed from a mixture of resin and ferromagnetic powder, such particles which are mixed with electrically conductive carbon or the like to adjust resistance, and such particles which are given surface treatment.

The magnetic particles 2*d*, constituting the magnetic brush 2*c*, must both properly inject charges into trap level on the surface of the photosensitive drum and prevent the charging member and photosensitive drum from breaking due to concentration of charging current on defects on the photosensitive drum, such as pinholes.

Thus the magnetic-bush charger 2A preferably ranges in resistance from $1\times10^4$ to $1\times10^9\Omega$, especially from $1\times10^4$ to $1\times10^7\Omega$. If the resistance of the magnetic-brush charger 2A is less than $1\times10^4\Omega$, leaks from pinholes easily occur. On the other hand, if the resistance is more than $10^9\Omega$, a charge is difficult to inject properly. To control the resistance to within the ranges, it is desirable that the magnetic particles 2*d* range in volume resistance from $1\times10^4$ to $1\times10^9$ Ω·cm, especially from $1\times10^4$ to $1\times10^7$ Ω·cm.

The magnetic-brush charger 2A used for the embodiment has an electrical resistance of $1\times10^6$ Ω·cm. Applying a voltage of −700 V as the DC component of the charging bias placed the surface of the photosensitive drum 1 at a potential of −700 V.

The volume resistance of magnetic particles 2*d* was measured using the procedure in FIG. 6. A cell A was packed with magnetic particles 2*d*. A main electrode 17 and an upper electrode 18 were disposed so that these electrodes were in contact with the magnetic particles 2*d*. When a voltage was applied between the electrodes 17 and 18, using a constant-voltage power supply 19, current was measured with an ammeter 20. Reference numeral 21 denotes insulation, 22 a voltmeter, and 23 a guide ring.

Measurements were made at 23° C. and a relative humidity of 65%. The area S of contact between the magnetic particles 2*d* and cell was 2 $cm^2$, the thickness d was 1 mm, the upper electrode 15 weighed 10 kg, and a voltage of 100 v was applied.

To prevent charging deterioration due to contaminated particle surfaces and also prevent magnetic-particle deposits on the surface of the photosensitive member, the average diameter of magnetic particles 2*d* and the peak of particle size distribution preferably range from 5 to 100 μm.

The average diameter of magnetic particles 2*d* is represented by the maximum horizontal chord length. The diameter of 300 particles or more chosen at random is measured under a microscope to calculate the arithmetic average for the measured diameters.

Figure 7:
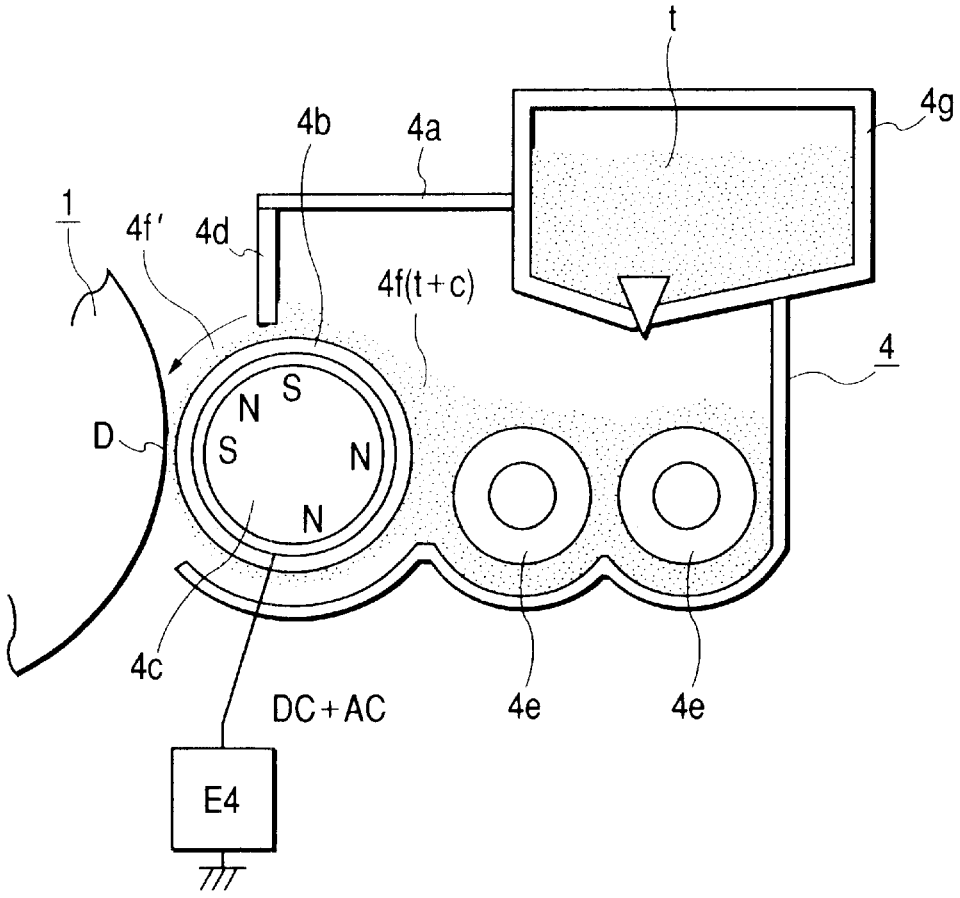
FIG. 7 is an enlarged schematic cross-sectional view of a developing apparatus.

(5) Developing Apparatus (FIG. 7)

Methods for developing an electrostatic latent image using toner are roughly classified as follows:

a. Non-magnetic toner is applied to a sleeve, using a blade or the like. Magnetic toner is applied to the sleeve, using magnetism and conveyed. Development is performed, with toner not in contact with a photosensitive member. (One-component non-contact development)

b. Toner is applied to a sleeve as described above. Development is performed, with toner in contact with a photosensitive member. (One-component contact development)

c. A developer, a mixture of toner particles and magnetic carriers, is conveyed, using magnetism. Development is performed, with the developer in contact with a photosensitive member. (2-component non-contact development)

d. Development is performed, with the 2-component developer not in contact with a photosensitive member. (2-component non-contact development)

Of these methods, 2-component non-contact development is most frequently used because of a high-quality image and high stability.

FIG. 7 is an enlarged schematic cross-sectional view of the developing apparatus used for the embodiment. The developing apparatus 4 of the embodiment is a 2-component magnetic-brush contact development type reverse development apparatus. The developing apparatus uses a mixture of a highly separable spherical-particle non-magnetic toner produced by polymerization and a magnetic carrier (developing magnetic particles and a developing carrier) as a developer. The developer, which is retained as a magnetic-brush layer on a developer carrier (developing member), using magnetism, is conveyed to a developing portion and brought into contact with a photosensitive drum to obtain a toner image by developing an electrostatic latent image.

A reference symbol 4*a* indicates a developing container; 4*b*, a developing sleeve as a developer carrier; 4*c*, a magnet, or magnetic-field generating means, which is secured in the developing sleeve 4*b*; 4*d*, a developer layer thickness limiting blade which is intended to form developer film on the developing sleeve; 4*e*, a developer stirring/conveying screw; 4*f*, a 2-component developer in the developing container 4*a*, that is, a mixture of a non-magnetic toner t and a developing carrier c which is made as described above.

The developing sleeve 4*b* is disposed so that the distance (clearance) between the sleeve and the photosensitive drum 1 is about 500 $\mu$m when the sleeve is nearest to the drum. The sleeve is intended to be brought in contact with the photosensitive drum 1 a developer magnetic-brush film 4*f'* provided around the developing sleeve 4*b*. A contact nip D between the developer magnetic-brush film 4*f'* and the photosensitive drum 1 is a developing region (developing portion).

The developing sleeve 4*b* is rotated around the secured magnet 4*c* in the sleeve counterclockwise as indicated by an arrow at a predetermined speed. In the developing container 4*a*, a magnetic brush is formed on the outside of the sleeve with the developer 4*f*(t+C) under the action of magnetism of the secured magnet 4*c*. As the sleeve 4*b* rotates, the magnetic brush, made of the developer, is conveyed. While conveyed, the brush is limited to a predetermined thickness by the blade 4*d* to turn the brush into the developer magnetic-brush film 4*f'*. The film is taken out of the developing container and conveyed to the developing portion D. Then the film comes in contact with the photosensitive drum 1. As the sleeve 4*b* further rotates, the film is returned to the developing container 4*a*.

A developing bias applying power supply E4 applies to the developing sleeve 4*b* a predetermined developing bias whose DC and AC components are superposed. If the difference between the charging potential (−700 V) of the photosensitive drum 1 and the DC component voltage of the developing bias is 200 V or less, the embodiment lets fog occur. If the difference is 350 V or more, the embodiment lets the developing carrier c be deposited on the photosensitive drum 1. To prevent these phenomena, the DC component of the developing bias was set to −400 V.

The concentration of toner in the developer 4*f*(t+c) (the mixing ratio of toner to the developing carrier c) gradually decreases because toner is used to develop an electrostatic latent image. Detecting means, not shown, detects the concentration of the toner 4*f* in the developing container 4*a*. If the concentration falls below a predetermined allowable lower limit, a toner replenishing unit 4*g* adds toner t to the developer 4*f* in the developing container 4*a* to keep the concentration of toner in the developer 4*f* within a predetermined allowable range.

(6) Cleanerless Process

Because the printer of the embodiment uses a cleanerless process, toner which remains on the photosensitive drum 1 after a toner image is transferred onto the recording material P is conveyed to the charging nip N of the photosensitive drum 1 and temporarily collected in the magnetic brush 2*c* of the magnetic-brush charger 2A of the magnetic-brush contact charging apparatus 2.

Residual toners with a positive polarity and those with a negative polarity frequently coexist on the photosensitive drum 1. These residual toners are conveyed to the magnetic-brush charger 2A and temporarily collected in the magnetic brush 2*c*. Applying the AC component to the magnetic-brush charger 2A causes residual toner to be more efficiently introduced into the magnetic brush 2*c* under the effect of a vibrating electric field between the magnetic-brush charger 2A and the photosensitive drum 1.

Residual toners introduced into the magnetic brush 2*c* are charged so that they are all negative in polarity and then discharged onto the photosensitive drum 1.

Then residual toner is conveyed to the developing portion D and collected under the action of a fog removal electric field by the developing sleeve 4*b* of the developing apparatus 4 during cleaning simultaneously with development. If an image region in the direction of rotation is longer than the circumference of the photosensitive drum 1, residual toner is collected in parallel with other image forming steps, including charging, exposure, development, and transfer.

Because toner is collected in the developing apparatus 4 and reused in the following steps, waste toner is prevented from occurring. Collecting toner also has the marked advantage of space saving, thus providing an image forming apparatus which is significantly reduced in size.

Using the highly separable spherical-particle toner t, produced by polymerization, for the developer reduces residual toner and allows more of the toner discharged from magnetic-brush charger 2A to be collected in the developing apparatus 4.

Using the 2-component contact development type developing apparatus 4 also allows more of the toner discharged from magnetic-brush charger 2A to be collected in the developing apparatus 4.

Toner usually has a comparatively high electrical resistance. If such toner permeates the magnetic brush 2*c* of the magnetic-brush charger 2A, the electrical resistance of the magnetic brush 2*c* increases, thus lowering charging performance. Thus if a relatively large amount of toner permeates the magnetic brush, discharging much toner when no image is formed keeps good charging.

When an image is formed, a small amount of toner is very uniformly sprayed from the magnetic brush 2*c* on the photosensitive drum 1, so that toner has no substantially detrimental effect on the next exposure. Moreover, a residual-toner pattern causes no ghost.

(7) Non-imaging Portion Discharged Toner and Non-imaging Portion Transfer Current (FIGS. 8 through 11)

When one image after another was formed, changes in the content of toner in the magnetic brush 2*c* were measured as follows, using the above-describe image forming apparatus.

Toner was discharged by stopping application of the AC component of the charging bias to the magnetic-brush charger 2A when no image was formed.

When toner was discharged as described above, the content of toner in the magnetic brush 2*c* decreased to about 1%. Thus the magnetic brush 2*c* was made to contain about 1% toner before discharging toner.

A transfer current of 10 μA was applied only when a region on the photosensitive drum 1 where an image was formed passed the transfer nip T. No transfer current was applied when no image was formed.

Images were formed one after another, using a lateral belt (in the main scanning direction) which is half as large as a 229 mm×324 mm sheet of paper (A4 size). Every time 1000 images were formed, three grams of magnetic particles was sampled from the magnetic brush 2*c* to measure the content of toner in the magnetic brush.

Using a surfactant, toner was rinsed from magnetic-particle samples. The samples were weighed before and after rinsing them. The content of toner in the magnetic brush was calculated from the weight difference.

The transfer efficiency was found to be about 95%.

Figure 8:
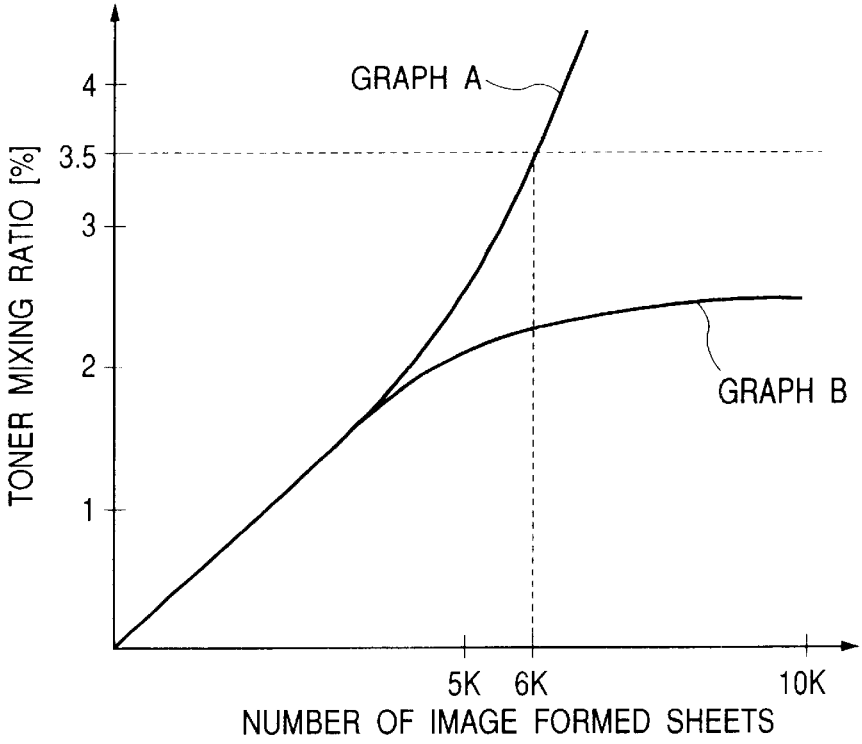
FIG. 8 shows the correlation between the number of sheets on which an image is formed and toner mixing ratio.

The graph A in FIG. 8 shows the results. The magnetic-brush charger 2A used for the embodiment cannot perform good charging if the content of toner in the magnetic brush is more than 3.5%. The graph A shows that the content of toner in the magnetic brush 2*c* exceeds 3.5% when more than 6000 images are formed. This is probably caused as follows. Toner discharged from the magnetic brush 2*c* may not be completely collected in the developing portion D when no image is formed. In this case, uncollected toner passes the transferring portion T and is recollected by the magnetic brush 2*c*. Thus continuous image formation causes toner to accumulate little by little in the magnetic brush 2*c*, so that the content of toner in the magnetic brush 2*c* exceeds 3.5%.

The graph B in FIG. 8 shows the correlation between the content of toner in the magnetic brush and the number of formed images as observed in the same experiment as described, with the transfer current set to 3 μA, when no image was formed. The graph B shows that the content of toner in the magnetic brush is stable, at 3.5% or less even when more than 10000 images are formed. The graph B is appreciably different from the graph A. This is probably caused as follows. Discharged toner which is not collected at the developing portion D is transferred at the transferring portion N from the photosensitive drum 1 onto the transfer belt 5*a*, a second image bearer. Then the discharged toner is removed from the transfer belt 5*a*, using the cleaning member 5*e* to prevent toner from permeating the magnetic brush 2*c*.

Figure 9:
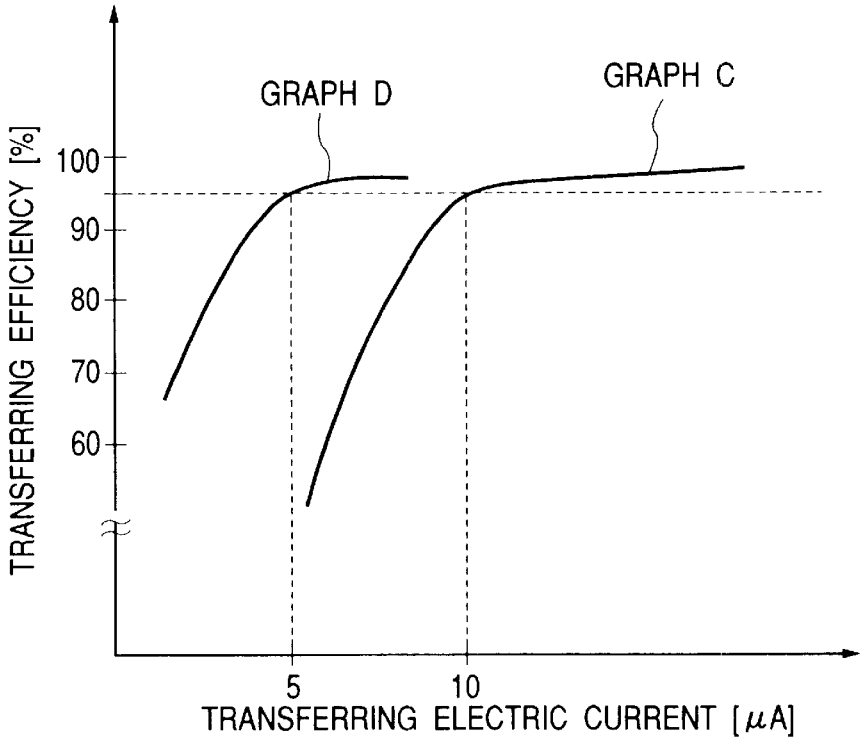
FIG. 9 shows the correlation between transfer current and transfer efficiency.

The graph C in FIG. 9 shows the correlation between transfer current and discharged toner transfer efficiency as observed when discharged toner is transferred from the photosensitive drum 1 onto the transfer belt Sa. The graph D shows the correlation between transfer current and transfer efficiency as observed when a toner image is transferred onto recording material. FIG. 9 shows that toner on a normal photosensitive drum markedly differs in terms of transferability from discharged toner.

For the embodiment, a transfer current of 10 μA was required for normal image formation, while a transfer current of 3 μA sufficed for discharged toner.

Figure 10:
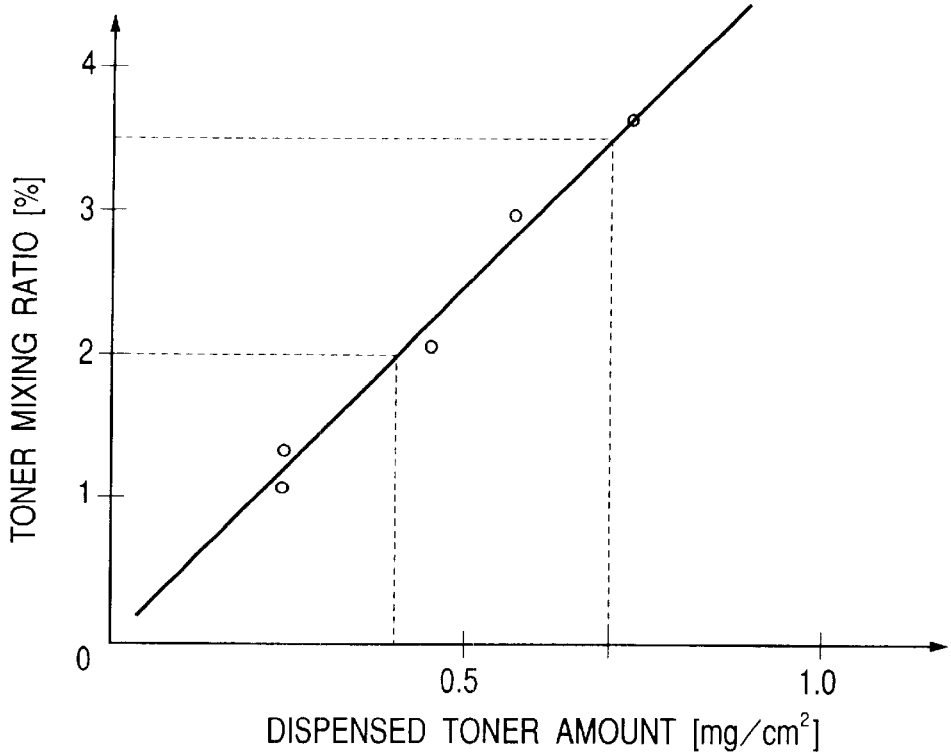
FIG. 10 shows the correlation between the amount of discharged toner and toner mixing ratio.

FIG. 10 shows the correlation between the content of toner in the magnetic brush 2*c* and the amount of toner discharged per unit area. As is clear from the figure, the amount of toner discharged varies with the amount of toner accumulating in the magnetic brush 2*c*. The larger the amount of toner accumulating in the brush, the larger the amount of discharged toner.

Figure 11:
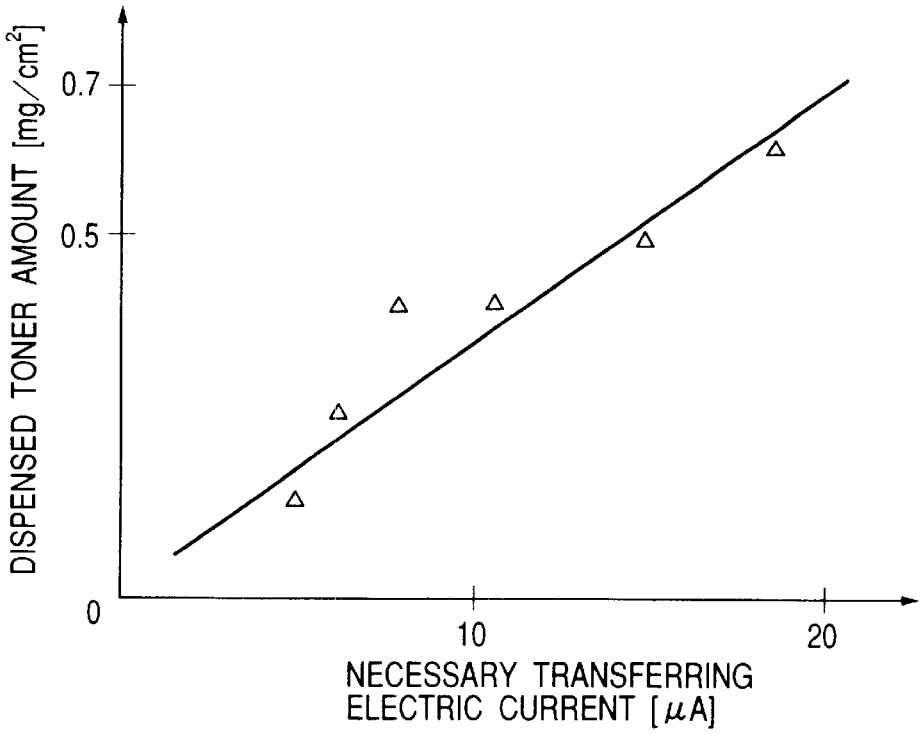
FIG. 11 shows the correlation between required transfer current and the amount of discharged toner.

FIG. 11 shows the correlation between the amount of toner discharged per unit area and the transfer current required to obtain a discharged toner transfer efficiency of 95%. As is clear from the figure, setting the transfer current for the intersheet and post-rotation processes to 3 μA as in the embodiment causes excessive or insufficient transfer current, depending on the amount of discharged toner, thus making it difficult to perform good discharge transfer. To prevent this problem, the transfer current is set to 3 μA in the embodiment when no image is formed. However, the transfer current set point varies, depending on the situation.

As described above, transferring onto the transfer belt 5*a* at the transferring portion T discharged toner which passes the developing portion D without fully being collected at the developing portion D allows stable images to be formed one after another.

<Second Embodiment> (FIGS. 12 Through 24)

The embodiment prevents a defective image from being caused by a color difference change due to the above-described retransfer and toner mixing.

Applying the cleanerless system to, for example, a tandem type color image forming apparatus causes a tint change due to retransfer as described above. This phenomenon was reproduced as follows.

Figure 12:
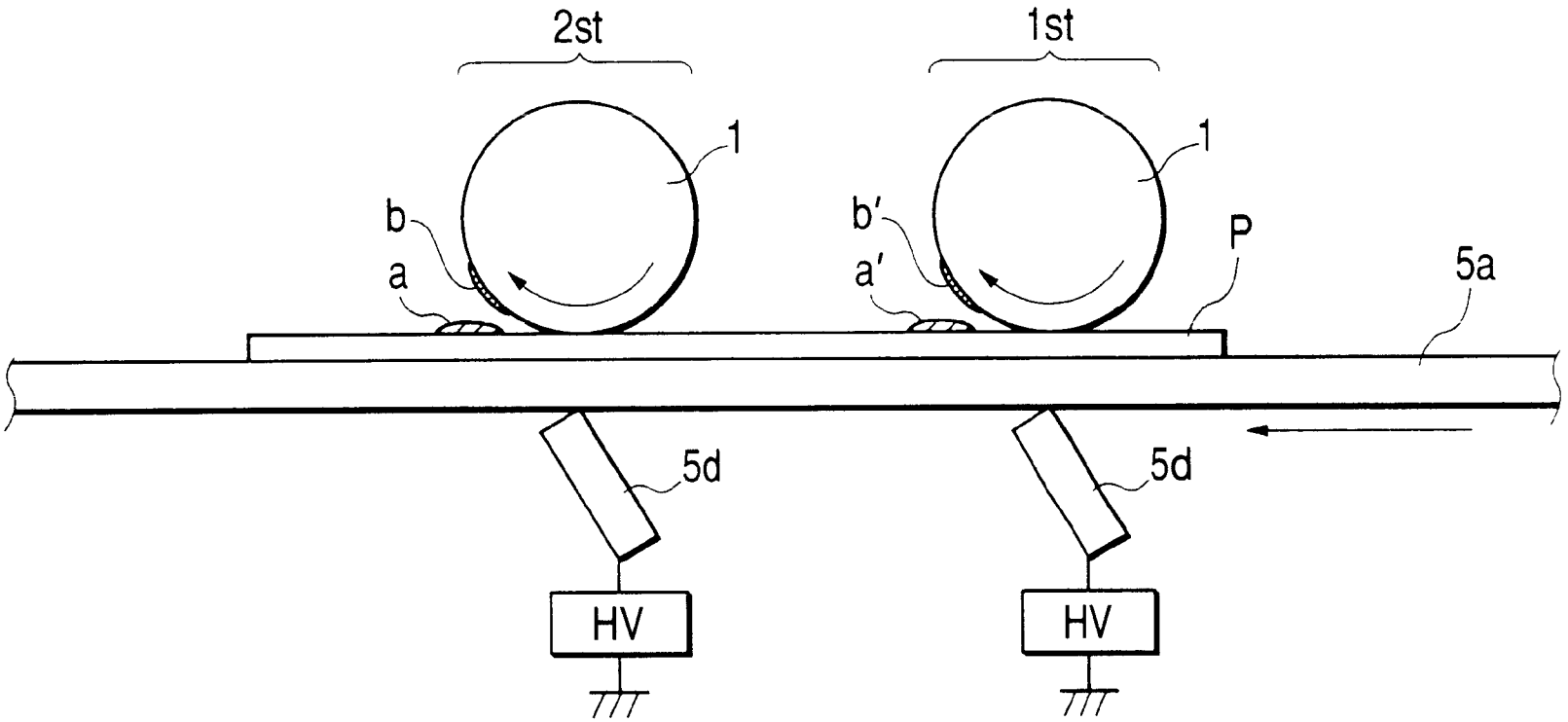
FIG. 12 is a schematic view of an image forming apparatus of a second embodiment.

As shown in FIG. 12, first and second image forming stations 1st and 2st are disposed so that the first image forming station is upstream of the second image forming station in the direction of recording material conveyance. Each image forming station, including the photosensitive drum 1, is a magnetic-brush contact charging type cleanerless electrophotographic system which performs reverse development. The reference symbols P, 5*a*, and 5*d* denotes recording material, a transfer belt, and an electrically conductive blade, respectively.

At each of the first and second image forming stations 1st and 2st, an image was formed, using a lateral belt (in the main scanning direction) which is 6% the size of a 229 mm×324 mm sheet of paper (A4 size).

At the second image forming station 2st, toner retransferred during image formation is collected by a magnetic brush in the second image forming station 2st and discharged onto the photosensitive drum after the toner is changed to a negative polarity. When retransferred toner reaches the developing portion after it is discharged, it is collected using a fog removal bias by the developing apparatus. To determine the amount of retransferred toner, the retransfer ratio ηrtr is defined as follows:

$$\eta rtr = b/(a+b) \times 100[\%]$$

where a (g/cm$^2$) is the amount of toner per unit area on the recording material P after retransfer, and b (g/cm$^2$) is the amount of toner retransferred onto the photosensitive drum per unit area, as shown in FIG. 12.

Similarly, the transfer ratio is defined as follows:

$$\eta tr = a'/(a'+b') \times 100[\%]$$

where a' (g/cm$^2$) is the amount of toner per unit area on the recording material after transfer, and b' (g/cm$^2$) is the amount of residual toner per unit area on the photosensitive drum.

In this discussion, a yellow toner and a magenta toner were used for the first and second image forming stations, respectively. A magenta image which was formed when the magenta developing device contained no yellow toner (a lateral band in the main scanning direction which is 6% the size of a 229 mm×324 mm sheet of paper) is initially used.

Every time 1000 images were formed, ten thousand sheets were passed to form the initial image (every time 100 sheets were passed, a pause was made). The color difference between the initial image and an image which was formed every time 1000 sheets were passed was measured, using an X-Rite SP68.

Further in this discussion, the transfer efficiency and retransfer ratio were 95% and 4%, respectively for the second image forming station.

Figure 13:
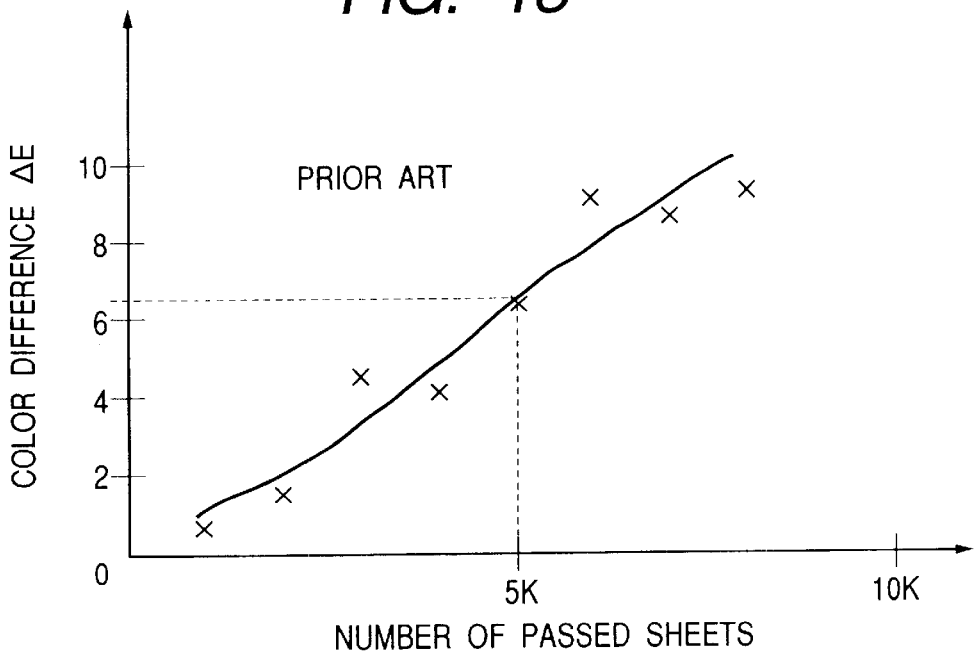
FIG. 13 shows the correlation between the number of sheets fed to a conventional color image forming apparatus and color difference.

In FIG. 13, the abscissa represents the number of passed sheets, and the ordinate represents color difference. The figure shows that the larger the number of passed sheets, the larger the color difference and that the color difference upper-limit (6.5), under which two different colors appear the same on an impression basis, is exceeded when the number of passed sheets reaches around 5000.

The foregoing shows that a toner recycling system which uses development causes retransferred toner to enter the developing apparatus, thus resulting in unallowable color difference.

In the embodiment, toner discharged from the magnetic brush is not collected in the developing portion D but transferred to the transfer belt, the second image bearer, in the transferring portion T and collected by the transfer belt cleaner 5*e* to solve the problem.

To prevent discharged toner from being collected in the developing portion D, the developing sleeve 4*d* is stopped in processes of FIG. 2 through which toner is discharged, that is, the intersheet and post-rotation processes so that possible collection should not be performed.

Figure 14:
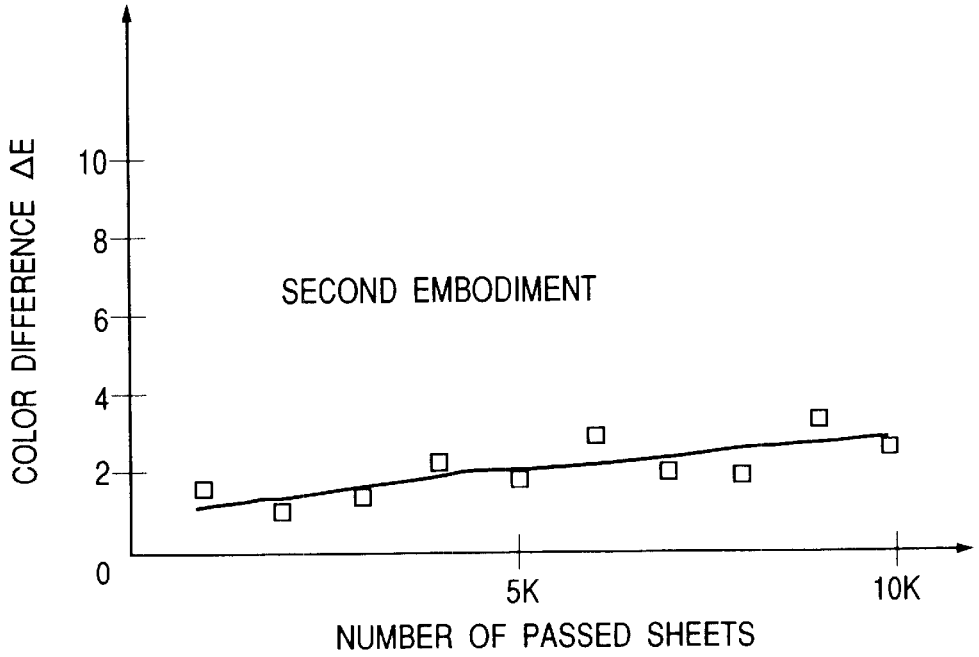
FIG. 14 shows the correlation between the number of sheets fed to a color image forming apparatus of the second embodiment and color difference.

To confirm the advantages of the embodiment, an analysis was again made as illustrated in FIGS. 12 and 13, with the developing sleeve 4*d* stopped in the intersheet and post-rotation processes, and the transfer current set to 5 $\mu$A for these processes. FIG. 14 shows the results similar to the above analysis.

As shown in FIG. 14, when the number of passed sheets increases, color difference increases only gradually, compared with FIG. 13. The color difference $\Delta E$ is stable, at about 3 even after 10000 sheets are passed. When the color difference has such a value, two different colors usually appear the same.

As described above, the embodiment significantly reduces color difference.

In the embodiment, when no image was formed (that is, in the intersheet and post-rotation processes), the transfer current was set based on the first embodiment in FIGS. 10 and 11. The amount of toner discharged per unit area varies from 0 to 0.7 mg/cm$^2$ when the content of toner in the magnetic brush is 3.5% or less. To set the toner transfer efficiency to 95% or more for such an amount of toner discharged per unit area, a transfer current of 0 to 20 $\mu$A is needed. However, because the content of toner in the magnetic brush is usually about 2.5% at most, a transfer current of 12 $\mu$A will do when no image is formed.

The embodiment is an example of an image forming apparatus which transfers the recording material P on the recording material bearer 5*a*. For example, a so-called an intermediate transfer type image forming apparatus with a plurality of image bearers and image forming units which makes multiple transfers to an intermediate transfer member in a first transferring portion and transfers all multiple-transfer images onto recording material in a second transferring portion has the same advantages as the embodiment.

<Third Embodiment> (FIGS. 15 Through 18)

Figure 15:
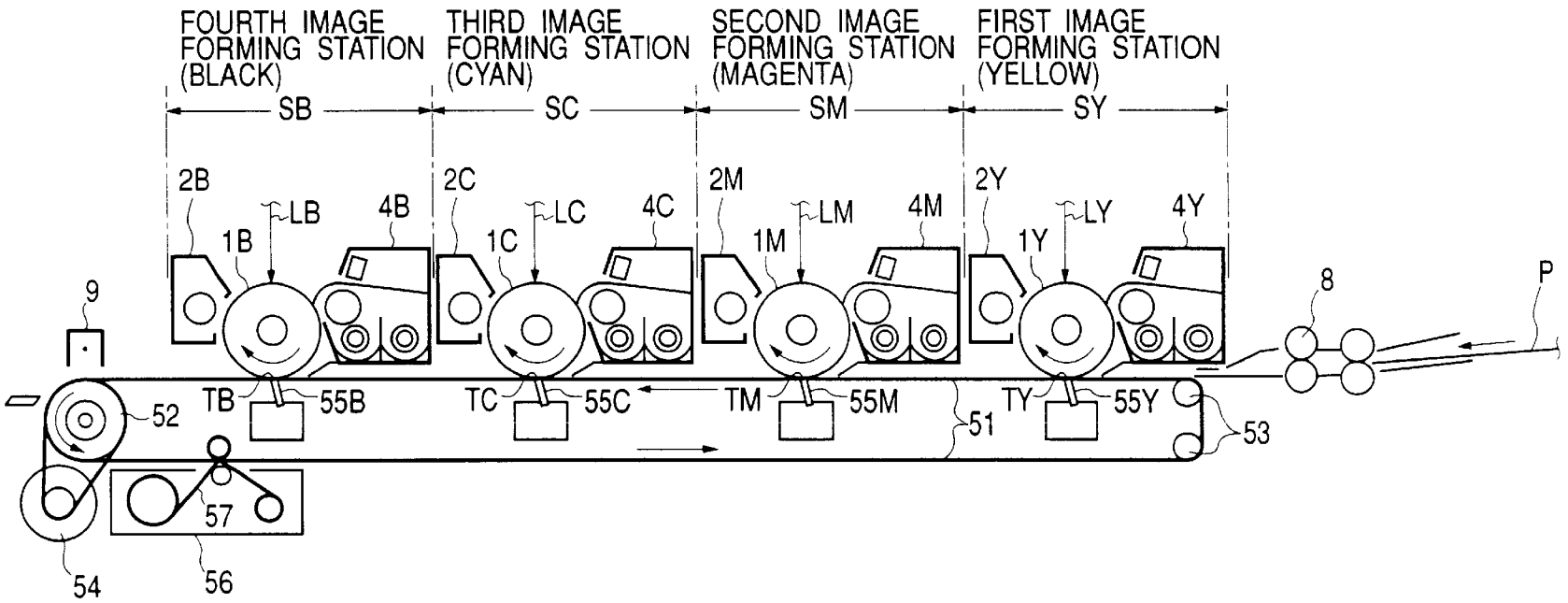
FIG. 15 is a schematic view of an image forming apparatus of a third embodiment.

FIG. 15 is a partial schematic view of an image forming apparatus of the embodiment.

Figure 20:
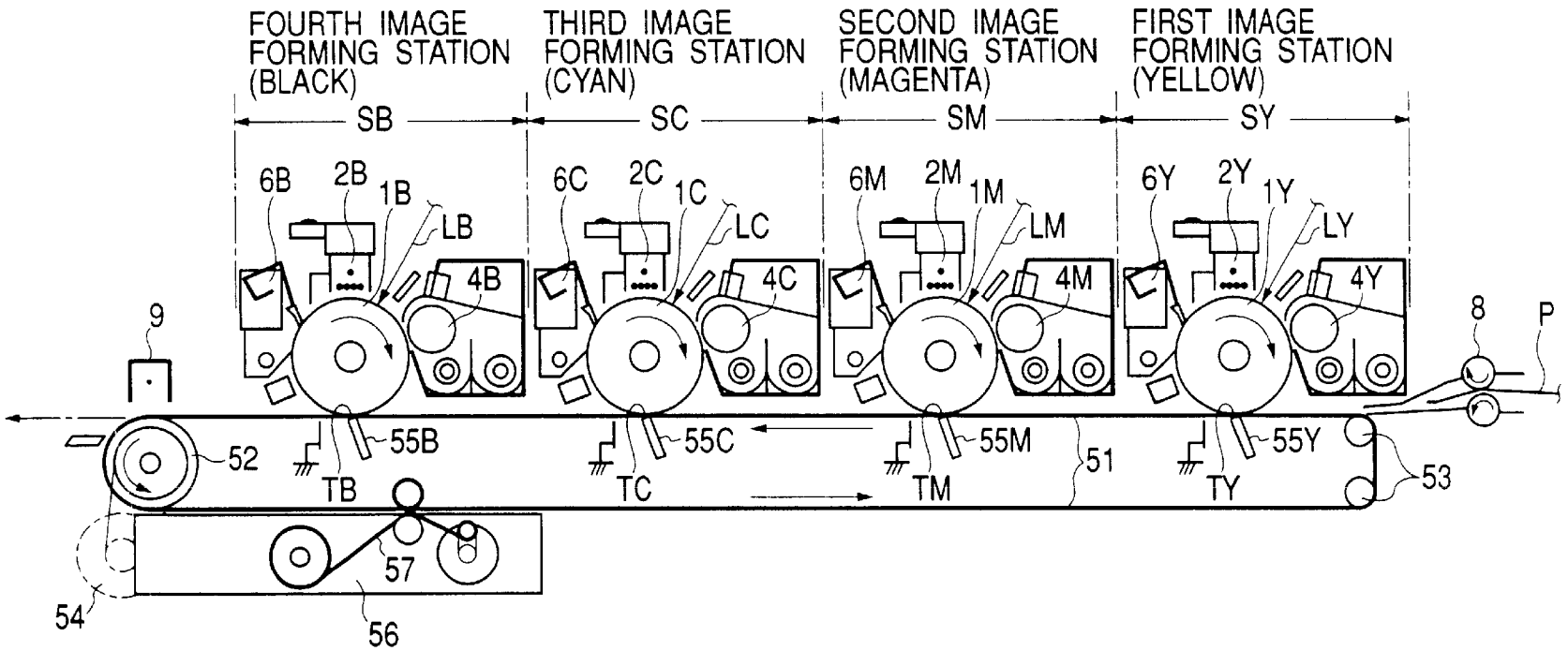
FIG. 20 is a schematic view of a conventional color image forming apparatus.

Like a conventional color image forming apparatus in FIG. 20, the image forming apparatus is of a tandem type which includes a plurality of electrophotographic mechanisms, image forming units (image forming stations), to form a color image.

Components, members, and portions which are common to the embodiment and the color image forming apparatus in FIG. 20 are given like reference numerals and symbols to omit descriptions.

In the color image forming apparatus, first, second, third, and fourth image forming stations SY, SM, SC, and SB, or image forming units, use a cleanerless process.

As is the case with the image forming apparatus of the first embodiment, photosensitive drums 1Y, 1M, 1C, and 1B are OPC photosensitive members 1 30 mm in diameter which are negatively charged by charge injection; charging apparatuses 4Y, 4M, 4C, and 4B are magnetic-brush charging apparatuses 2; and developing apparatuses 4Y, 4M, 4C, and 4B are 2-component magnetic-brush contact development type reverse developing apparatuses 4.

The charging bias, developing bias, transferring bias, and the like are the same as in the case of an image forming apparatus of the first embodiment. The photosensitive drums 1Y, 1M, 1C and 1B are rotated at a process speed of 150 mm/sec and uniformly charged using charge injection by the magnetic-brush charging apparatuses 2Y, 2M, 2C, and 2B until the drums are at a potential of about −700 V. A transfer belt 51 is, for example, 75 $\mu$m thick and made of polyimide.

As described above, the first, second, third, and fourth image forming stations SY, SM, SC, and SB use a cleaner process. No special cleaner removing toner which is not transferred onto the recording material P at the transfer nip TY, TM, TC, and TB but left on the photosensitive drums 1Y, 1M, 1C, and 1B is installed in each image forming station. As is the case with image forming apparatuses of the first and second embodiments, when residual toner reaches the magnetic-brush charging apparatuses 2Y, 2M, 2C, and 2B due to rotation of the photosensitive drums 1Y, 1M, 1C, and 1B, the residual toner is temporarily collected by the magnetic brush 2*c* of the magnetic-brush charging apparatus 2A, a contact charging member in contact with the photosensitive members 1Y, 1M, 1C, and 1B. Then the collected toner is discharged onto the photosensitive drums 1Y, 1M, 1C, and 1B. After passing the developing portion D, discharged toner is directly transferred onto the transfer belt 51, a second image bearer, in the transferring portions TY, TM, TC, and TB and finally, collected by the transfer belt cleaner 56.

Figure 16:
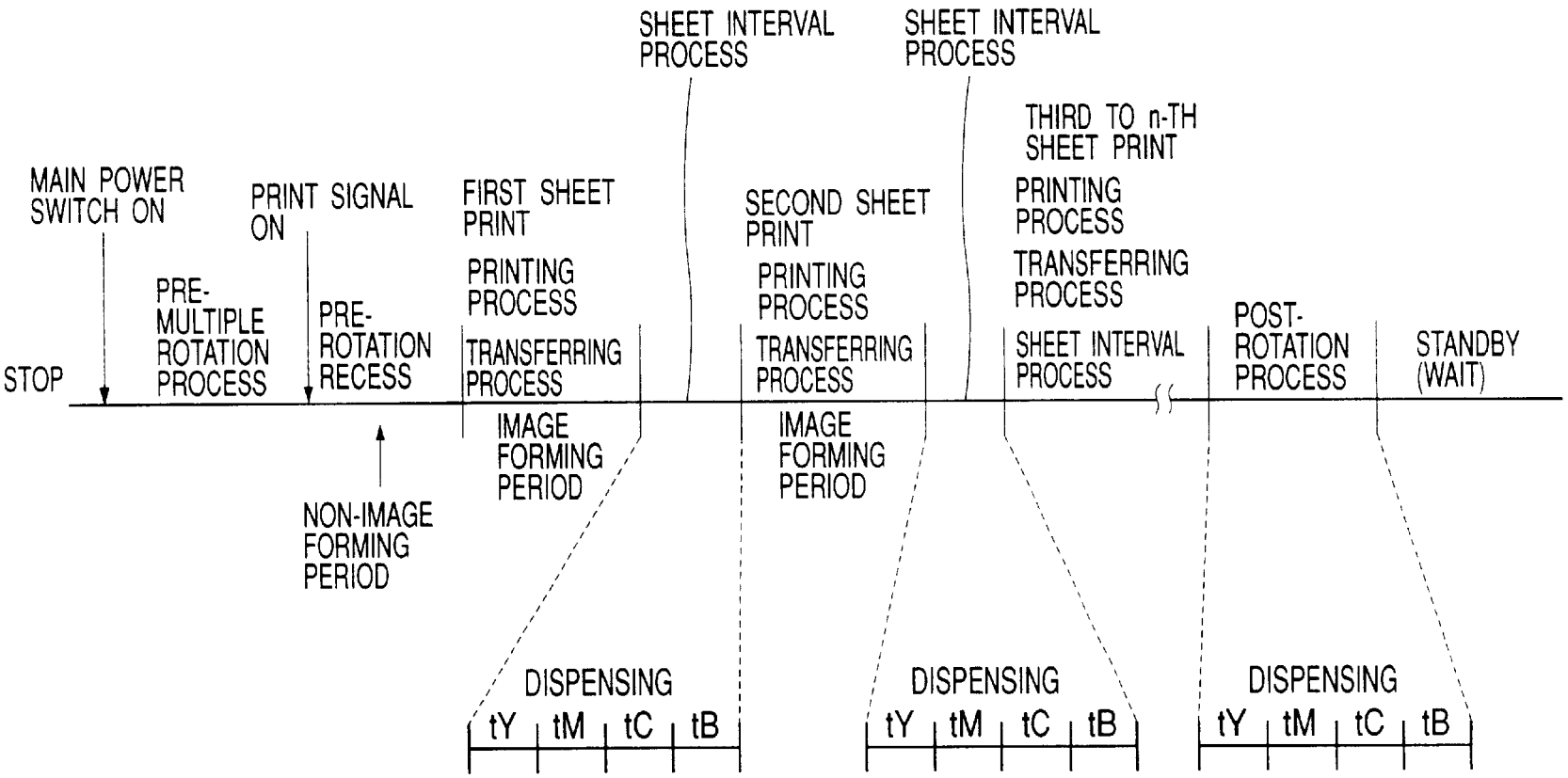
FIG. 16 shows an operational sequence for the image forming apparatus.

FIG. 16 shows an operational sequence for the image forming apparatus. This sequence is like the operational sequence in FIG. 2 for the first embodiment. In the intersheet process, a region on the photosensitive drums 1Y, 1M, 1C, and 1B passes the charging nips TY, TM, TC, and TB before passing the transfer nips TY, TM, TC, and TB. The application of the AC component of a charging bias is stopped to discharge residual toner temporarily collected by the magnetic-brush charging member onto the photosensitive drums 1Y, 1M, 1B, and 1C. In the post-rotation process also, application of the AC component of a charging bias is stopped to discharge residual toner temporarily collected by the magnetic-brush charging member onto the photosensitive drums 1Y, 1M, 1B, and 1C as in the intersheet process.

(1) Cleanerless Process

Because the printer of the embodiment uses a cleanerless process, toner which remains on the photosensitive drums 1Y, 1M, 1C, and 1B after a toner image is transferred onto the recording material P is conveyed to the charging nip N of the photosensitive drum 1Y, 1M, 1C, and 1B and temporarily collected in the magnetic brush 2*c* of the magnetic-brush charger 2A of the magnetic-brush contact charging apparatus 2Y, 2M 2C, and 2B.

Residual toners with a positive polarity and those with a negative polarity frequently coexist. These residual toners are conveyed to the magnetic-brush charger 2A and temporarily collected in the magnetic brush 2*c*.

Applying the AC component to the magnetic-brush charger 2A causes residual toner to be more efficiently introduced into the magnetic brush 2*c* under the effect of a vibrating electric field between the magnetic-brush charger 2A and the photosensitive drums 1Y, 1M, 1C, and 1B.

Residual toners introduced into the magnetic brush 2*c* are charged so that they are all negative in polarity and then discharged onto the photosensitive drums 1Y, 1M, 1C, and 1B.

Then residual toner discharged onto the photo sensitive drums 1Y, 1M, 1C and with its polarity aligned is conveyed to the developing portion D of the developing apparatuses 4Y, 4M, 4C, and 4B. In the developing portion D, the developing sleeve 4*d* is stopped, and only the DC component of a developing bias is applied with the AC bias off, so that discharged toner passes the developing portion D.

Next, discharged toner passing the developing portion D is transferred onto the transfer belt 51 by applying in the transferring portions TY, TM, TC, and TB a transfer electric field which is opposite in polarity to the toner.

After transferred onto the transfer belt 51, discharged toner passes a downstream transferring portion and then is collected by the transfer belt cleaner 56.

Collecting all residual toner using the transfer belt cleaner 56 has the marked advantage of space saving, thus providing an image forming apparatus which is significantly reduced in size.

Using the highly separable spherical-particle toner t, produced by polymerization, for the developer reduces residual toner and allows transferability of the toner discharged from magnetic-brush charger 2A to be increased.

Toner usually has a comparatively high electrical resistance. If such toner permeates the magnetic brush 2*c* of the magnetic-brush charger 2A, the electrical resistance of the magnetic brush 2*c* increases, thus lowering charging performance. Thus if a relatively large amount of toner permeates the magnetic brush, discharging much toner when no image is formed keeps good charging.

When an image is formed, a small amount of toner is very uniformly sprayed from the magnetic brush 2*c* on the photosensitive drums 1Y, 1M, 1C, and 1B, so that toner has no substantially detrimental effect on the next exposure. Moreover, a residual-toner pattern causes no ghost.

(2) Retransferability of Discharged Toner

If toner discharged from the first, second, third, and fourth image forming stations SY, SM, SC, and SB onto the transfer belt 51 undergoes multiple transfers, a problem arises: the toner is retransferred at a downstream image forming station and collected by the magnetic brush of the station.

Figure 17:
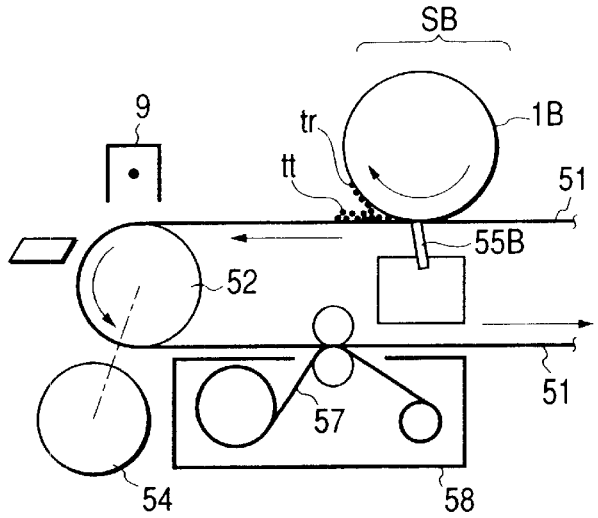
FIG. 17 illustrates multiple transfers of toner discharged from the image forming stations onto the transfer belt.

In FIG. 17, a reference symbol tt denotes toners tY, tM, tC, and tB which are discharged onto transfer belt 51 from the first, second, third, and fourth image forming stations SY, SM, SC, and SB and transferred a plurality of times. A reference symbol tr denotes part of the toners tt which is retransferred at the fourth image forming station SB.

Discharged toner more easily attaches to a photosensitive drum than ordinary toner as used for image formation. Thus discharged toner is liable to remain during transfer. It is also easy to retransfer.

The more toner is on the transfer belt 51, the more easily toner retransfer occurs.

Figure 18:
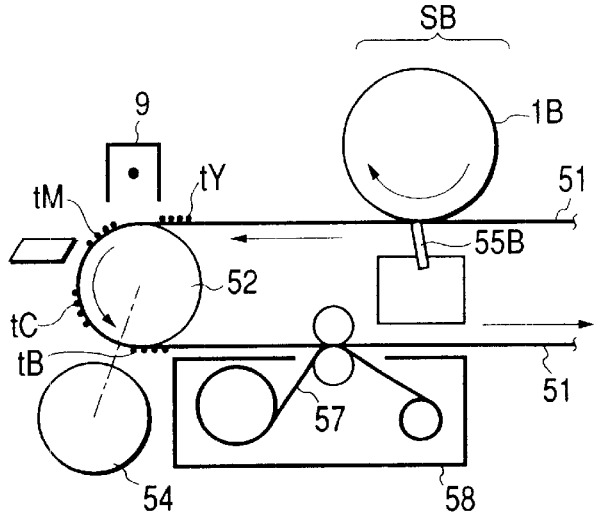
FIG. 18 illustrates timing control which is exercised over toner discharge from the image forming stations to the transfer belt to prevent discharged toners from overlapping on the transfer belt.

Thus the discharged toners tY, tM, tC, and tB which are discharged from the first, second, third, and fourth image forming stations onto the transfer belt 51 can be prevented from being retransferred (FIG. 16) by shifting their transfer timing so that they do not overlap on the transfer belt 51 (FIG. 18).

Thus after passing the image forming stations, the discharged toners tY, tM, tC, and tB are conveyed to the transfer belt cleaner 56.

(3) Ease of Discharged Toner Cleaning

Because discharged toner is collected by the magnetic brush, or it passes the developing device and transferring portion, it is deformed or covered with foreign matter. Thus discharged toner is difficult to clean from the transfer belt, using the transfer belt cleaner 56.

If a large amount of the discharged toners tY, tM, tC, and tB is transferred a plurality of times, so that they reach the transfer belt cleaner 56, they are sometimes not completely cleaned from the transfer belt but pass the cleaner.

If the discharged toners tY, tM, tC, and tB which are discharged from the first, second, third, and fourth image forming stations onto the transfer belt 51 are conveyed little by little to the transfer belt cleaner 56 by shifting their transfer timing so that they do not overlap on the transfer belt 51, they can easily be removed from the transfer belt.

As described above, by shifting the timing of toner discharge from the image forming stations SY, SM, SC, and SB to the transfer belt 51, the charging performance of a magnetic brush can be kept high.

<Fourth Embodiment>

The fourth embodiment is an image forming apparatus of the third embodiment, wherein the developing apparatuses 4Y, 4M, 4C, and 4B develop toner discharged from the magnetic brush 2*c* of the charging apparatuses 2Y, 2M, 2C, and 2B onto the photosensitive drums 1Y, 1M, 1C, and 1B when the toner passes the developing portion D.

After being discharged from the magnetic brush 2*c* onto the photosensitive drums 1Y, 1M, 1C, and 1B, residual toner is conveyed through the developing portion D to the transferring portions TY, TM, TC, and TB. However, part of the discharged toner remains in the developing portion D. Thus toner which is difficult to transfer sometimes stagnate in the developing apparatuses 4Y, 4M, 4C, and 4B.

To prevent discharged toner from being collected by the developing apparatuses, the fourth embodiment blocks discharged toner by developing fresh toner.

Such control as described above may make the cleanerless system more stable.

Figure 19:
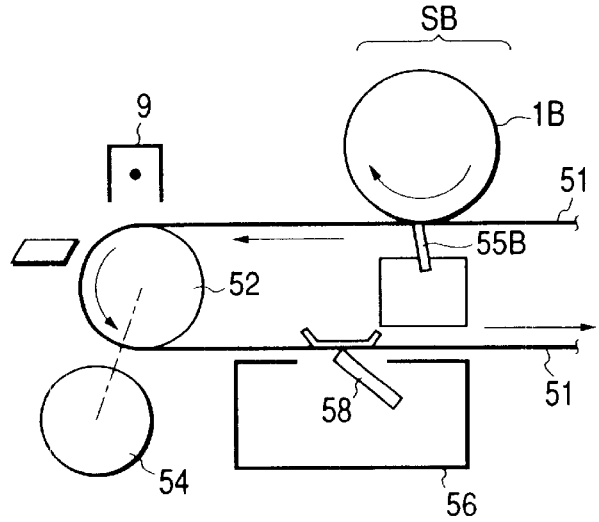
FIG. 19 is a schematic view of an image forming apparatus of a fifth embodiment.

<Fifth Embodiment> (FIG. 19)

The embodiment is an image forming apparatus of the third or fourth embodiment, wherein the transfer belt cleaner 56 of a blade cleaning type is used as shown in FIG. 19. Reference numeral 58 denotes a cleaner blade. Toner is more actively developed, transferred, and fed to the transfer belt cleaner 56 to lubricate a cleaner blade nip.

As is the case with the fourth embodiment, feeding toner to the transfer belt cleaner 56 when toner is discharged prevent discharged toner from being collected by a developing apparatus.

Such a control as described above may make not only the cleanerless system but transfer belt cleaning more stable.

The third, fourth, and fifth embodiments can be applied to an intermediate transfer member type color image forming apparatus.

<Others>

1) The magnetic-brush charger 2A, a contact charging member, is not limited to a sleeve rotation type. Magnetic-brush chargers are available wherein a magnetic roll rotates, or to rotate a magnetic roll, a magnetic brush is formed by magnetically attracting electrically conductive magnetic particles directly around a magnet roll whose surface is made electrically conductive as required to use the surface as a power supply electrode. A magnetic-brush charging member is also available which does not rotate.

The contact charging member may be a fur brush, a charging roller made of electrically conductive rubber or sponge, or the like. Such a member is available which does not rotate.

2) To perform charge injection charging and prevent ozone formation, a photosensitive member serving as an image bearer desirably has a low-resistance layer with a surface resistance of $10^9$ to $10^{14}$ Ω·cm. However, other organic photosensitive members may be used. That is, contact charging is not limited to charge injection as in the embodiments but it may be a contact charging system in which discharge phenominon is predominant.

3) Only the charging apparatus that uses a 2-component developing method is described above. However, the apparatus may use other developing methods. A one-component contact developing method and a 2-component contact developing method which preferably develops a latent image by bringing a developer into contact with a photosensitive member promotes simultaneous developer collection.

If a polymerized toner is used for a developer, not only one-component and 2-component contact developing methods as described above but other methods, including a one-component non-contact developing method and a 2-component non-contact developing method, provide satisfactory developer collection.

The developing apparatus may be of either a reverse development type or a regular development type.

4) The AC (alternating current) waveform can be sinusoidal, rectangular, or triangular as appropriate. A rectangular waveform may be formed by periodically turning on and off a DC power supply. As described above, a bias whose value periodically changes can be used as an AC voltage.

5) An image forming apparatus is not limited to the processes of the embodiments but may use any image forming process. Other auxiliary process equipment may be used as required.

Image forming means for forming an electrostatic latent image is not limited to laser scanning exposing means for forming a digital latent image as in the embodiments. Ordinary analog image exposure and other light emitting elements, such as LEDs, may be used. Alternatively, image exposing means which can form a latent image corresponding to image information will do, including a combination of a light emitting element, such as a fluorescent lamp, and a liquid crystal shutter or the like.

The image bearer may be electrostatic recording dielectric. In this case, the surface of the dielectric undergoes uniform primary charging to have a predetermined polarity and be at a predetermined potential. Then electricity is selectively discharged from the surface, using arresting means, such as an arrester head or an electron gun, to form an intended image.

6) Material onto which a toner image is transferred from an image bearer may be an intermediate transfer member (a second image bearer), such as an intermediate transfer drum or an intermediate transfer belt.

7) Transferring means is not limited to the transfer belt of the embodiments but may be a corona charger (corona charging transfer), a charging roller (roller transfer), an electrically conductive brush, an electrically conductive blade, etc.

8) An image forming apparatus can be arranged to be of a process cartridge installation type which allows process equipment, such as the image bearer 1, charging apparatus 2, and developing device 4, to be removably installed to the image forming apparatus or replaced as a unit.

In a contact charging cleanerless type image forming apparatus, an excessive amount of residual developer accumulates on the charging member, or not all developer cannot be collected by the developing device during image transfer because of repeated image formation and excessively low transfer efficiency caused by environmental variations. Such residual developer causes fog. A tandem type color image forming apparatus or the like forms a defective image caused by tint variations due to retransfer, etc. As described in detail above, the present invention prevents these problems, thus allowing good images to be stably formed in succession.

Retransfer occurs if a large amount of discharged developer is conveyed to the transferring portion of a downstream image forming unit. To prevent this phenomenon, a color image forming apparatus of a tandem type or the like with a plurality of contact charging cleanerless type image forming units controls timing of residual toner discharge from the image bearers of the units onto a recording material bearer or an intermediate transfer member so that discharged developers do not overlap on the recording material bearer or intermediate transfer member. Thus discharged toner can securely be collected by cleaning means for the recording material bearer or intermediate transfer member. Moreover, a large amount of discharged developer is prevented from being conveyed to the cleaning means for the recording material bearer or intermediate transfer member at a time, so that reliable cleaning can be performed.

The embodiments of the present invention have been described above. The present invention is not limited to these embodiments, but variations and modifications can be made without departing from the scope and spirit of the present invention.

What is claimed is:

1. An image forming apparatus comprising:

an image bearer which carries an electrostatic image;

developing means for developing the electrostatic image using toner;

a rotating transfer member which transfers a toner image on said image bearer;

charging means for charging said image bearer on which residual toner is deposited due to transfer by said rotating transfer member, the charging means allowing residual toner on said image bearer to be collected;

returning means for returning toner in said charging means to said image bearer, when the image is not formed; and removing means for removing toner on said rotating transfer means, said rotating transfer member transferring at least a portion of the returned toner to said image bearer returned by said returning means, when the image is not formed.

2. The image forming apparatus according to claim 1, wherein said developing means allows toner on said image bearer to be collected, and toner which is returned to said image bearer by said returning means but cannot be collected by said developing means is transferred onto said rotating transfer member.

3. The image forming apparatus according to claim 1, wherein said developing means allows toner on said image bearer to be collected, and toner which is returned by said returning means is not substantially collected.

4. The image forming apparatus according to claim 3, wherein said developing means includes a toner carrier, which feeds toner to said image bearer and collects toner from said image bearer, and said toner carrier stops rotating when returned toner passes a developing portion.

5. The image forming apparatus according to claim 1, wherein said rotating transfer member bears and conveys recording material.

6. The image forming apparatus according to claim 1, wherein said rotating transfer member is an intermediate transfer member, which temporarily bears a toner image before transferring the toner image onto recording material.

7. The image forming apparatus according to claim 1, wherein different transfer currents run when said rotating transfer member transfers a toner image and when said rotating transfer member transfers toner returned by said returning means.

8. The image forming apparatus according to claim 7, wherein a smaller current runs when the returned toner is transferred than when the toner image is transferred.

9. The image forming apparatus according to claim 1, wherein said returning means returns toner to a region on said image bearer where no image is formed.

10. The image forming apparatus according to claim 9, wherein said returning means applies to said charging means a voltage which differs from one which is applied to the means when an image is formed.

11. The image forming apparatus according to claim 10, wherein a vibration voltage is applied to said charging means when an image is formed, and the return voltage has a vibration component, which is smaller than when an image is formed.

12. The image forming apparatus according to claim 10, wherein a vibration voltage is applied to said charging means when an image is formed, and the return voltage is a DC voltage.

13. The image forming apparatus according to claim 1, wherein said charging means has a brush, which rubs said image bearer.

14. The image forming apparatus according to claim 13, wherein the brush comprises a magnetic brush made of magnetic particles.

15. An image forming apparatus comprising:

first and second image forming stations, said first and second image forming stations both including an image carrier, which carries an electrostatic image, charging means for collecting residual toner on said image bearer and charging said image bearer, developing means for developing the toner image on said image bearer using toner, and returning means for returning toner in the said charging means to said image bearer;

a rotating transfer member, which superposes and transfers toner images on said image bearers of said first and second image forming stations, said rotating transfer member transferring at least a portion of toner returned from said charging means to said image bearers of said first and second image forming stations; and controlling means for controlling the timing of toner return by the returning means of said first image forming station and that of said second image forming station so that toner returned from said first image forming station and toner returned from said second image forming station differ in position on said rotating transfer member.

16. The image forming apparatus according to claim 15, wherein said developing means allows toner on said image bearers of said first and second image bearing stations to be collected, and toner, which is returned to said image bearers of said first and second image bearing stations by said returning means of said first and second image bearing stations but cannot be collected by said developing means of said first and second image bearing stations is transferred onto said rotating transfer member.

17. The image forming apparatus according to claim 15, wherein said developing means of said first and second image bearing stations allows toner on said image bearers of said first and second image bearing stations to be collected, and toner, which is returned by said returning means of said first and second image bearing stations is not substantially collected.

18. The image forming apparatus according to claim 17, wherein said developing means of said first and second image bearing stations include a toner carrier, which feeds toner to said image bearers of said first and second image bearing stations and collects toner from said image bearers of said first and second image bearing stations, and the toner carrier stops rotating when returned toner passes a developing portion.

19. The image forming apparatus according to claim 15, wherein said rotating transfer member bears and conveys recording material.

20. The image forming apparatus according to claim 15, wherein said rotating transfer member is an intermediate transfer member, which temporarily bears a toner image before transferring the toner image onto recording material.

21. The image forming apparatus according to claim 20, wherein different transfer currents run when said rotating transfer member transfers a toner image and when said rotating transfer member transfers toner returned by said returning means.

22. The image forming apparatus according to claim 21, wherein a smaller current runs when the returned toner is transferred than when the toner image is transferred.

23. The image forming apparatus according to claim 15, wherein said returning means of said first and second image bearing stations returns toner to a region on said image bearers of said first and second image bearing stations where no image is formed.

24. The image forming apparatus according to claim 23, wherein said returning means of said first and second image bearing stations applies to charging means a voltage, which differs form one which is applied to the means when an image is formed.

25. The image forming apparatus according to claim 24, wherein a vibration voltage is applied to said charging means of said first and second image bearing members, and the return voltage has a vibration component, which is smaller than when an image is formed.

26. The image forming apparatus according to claim 24, wherein a vibration voltage is applied to said charging means of said first and second image bearing members when an image is formed, and the return voltage is a DC voltage.

27. The image forming apparatus according to claim 15, wherein said charging means includes a brush, which rubs said image bearers of said first and second image bearing members.

28. The image forming apparatus according to claim 27, wherein the brush comprises a magnetic brush made of magnetic particles.

29. The image forming apparatus according to claim 15, further comprising a cleaning member, which cleans the said rotating transfer member.

* * * * *

UNITED STATES PATENT AND TRADEMARK OFFICE

CERTIFICATE OF CORRECTION

PATENT NO. : 6,449,448 B2
DATED : September 10, 2002
INVENTOR(S) : Yuji Bessho et al.

It is certified that error appears in the above-identified patent and that said Letters Patent is hereby corrected as shown below:

Column 1,
Line 46, "forms" should read -- forms an electrostatic latent image --; and
Lines 47 and 48, "an electrostatic latent image" should be deleted.

Column 3,
Line 1, "image" should read -- the image --;
Line 13, "attracts" should read -- attract --; and
Line 61, "which paper" should read -- which --.

Column 5,
Line 7, "allows" should read -- allowing --.

Column 7,
Line 53, "hip" should read -- nip --; and
Line 57, "hip" should read -- nip --.

Column 9,
Line 64, "If" should read -- 1f --.

Column 14,
Line 64, "above-describe" should read -- above-described --.

Column 15,
Line 52, "Sa." should read -- 5a. --.

Column 16,
Line 26, "2st" should read -- $2^{nd}$ --;
Line 36, "2st," should read -- $2^{nd}$, --;
Line 39, "2st," should read -- $2^{nd}$, --; and
Line 41, "2st" should read -- $2^{nd}$ --.

Column 19,
Line 37, "for" should be deleted.

UNITED STATES PATENT AND TRADEMARK OFFICE

CERTIFICATE OF CORRECTION

PATENT NO. : 6,449,448 B2
DATED : September 10, 2002
INVENTOR(S) : Yuji Bessho et al.

It is certified that error appears in the above-identified patent and that said Letters Patent is hereby corrected as shown below:

Column 20,
Line 44, "stagnate" should read -- stagnates --; and
Line 60, "prevent" should read -- prevents --.

Column 24,
Line 46, "form" should read -- from --.

Signed and Sealed this

Twenty-first Day of January, 2003

JAMES E. ROGAN
*Director of the United States Patent and Trademark Office*